US010453397B2

(12) United States Patent
Nathan et al.

(10) Patent No.: US 10,453,397 B2
(45) **Date of Patent: *Oct. 22, 2019**

(54) STABLE DRIVING SCHEME FOR ACTIVE MATRIX DISPLAYS

(71) Applicant: Ignis Innovation Inc., Waterloo (CA)

(72) Inventors: Arokia Nathan, Cambridge (GB); Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/159,944

(22) Filed: Oct. 15, 2018

(65) Prior Publication Data

US 2019/0051248 A1 Feb. 14, 2019

Related U.S. Application Data

(63) Continuation of application No. 15/807,339, filed on Nov. 8, 2017, now Pat. No. 10,127,860, which is a (Continued)

(30) Foreign Application Priority Data

Apr. 19, 2006 (CA) ..... 2544090

(51) Int. Cl.
*G09G 3/3258* (2016.01)
*G09G 3/3233* (2016.01)
*G09G 3/3208* (2016.01)

(52) U.S. Cl.
CPC ..... *G09G 3/3258* (2013.01); *G09G 3/3208* (2013.01); *G09G 3/3233* (2013.01); (Continued)

(58) Field of Classification Search
CPC ..... G09G 3/3233; G09G 3/3258; G09G 2320/043; G09G 2310/0254; (Continued)

(56) References Cited

U.S. PATENT DOCUMENTS 3,506,851 A 4/1970 Polkinghorn
3,774,055 A 11/1973 Bapat
(Continued)

FOREIGN PATENT DOCUMENTS

CA 1294 034 1/1992
CA 2 109 951 11/1992
(Continued)

OTHER PUBLICATIONS

Ahnood : "Effect of threshold voltage instability on field effect mobility in thin film transistors deduced from constant current measurements"; dated Aug. 2009.
(Continued)

*Primary Examiner* — Michael Pervan
(74) *Attorney, Agent, or Firm* — Stratford Managers Corporation

(57) ABSTRACT

A method and system for operating a pixel array having at least one pixel circuit is provided. The method includes repeating an operation cycle defining a frame period for a pixel circuit, including at each frame period, programming the pixel circuit, driving the pixel circuit, and relaxing a stress effect on the pixel circuit, prior to a next frame period. The system includes a pixel array including a plurality of pixel circuits and a plurality of lines for operation of the plurality of pixel circuits. Each of the pixel circuits includes a light emitting device, a storage capacitor, and a drive circuit connected to the light emitting device and the storage capacitor. The system includes a drive for operating the plurality of lines to repeat an operation cycle having a frame period so that each of the operation cycle comprises a programming cycle, a driving cycle and a relaxing cycle for relaxing a stress on a pixel circuit, prior to a next frame period.

20 Claims, 10 Drawing Sheets

Related U.S. Application Data continuation of application No. 15/462,529, filed on Mar. 17, 2017, now Pat. No. 9,842,544, which is a continuation of application No. 14/263,628, filed on Apr. 28, 2014, now Pat. No. 9,633,597, which is a continuation of application No. 13/909,177, filed on Jun. 4, 2013, now Pat. No. 8,743,096, which is a continuation of application No. 11/736,751, filed on Apr. 18, 2007, now Pat. No. 8,477,121.

(52) U.S. Cl.
CPC ..... *G09G 2300/0814* (2013.01); *G09G 2300/0819* (2013.01); *G09G 2300/0842* (2013.01); *G09G 2300/0866* (2013.01); *G09G 2310/0254* (2013.01); *G09G 2310/0256* (2013.01); *G09G 2320/0233* (2013.01); *G09G 2320/043* (2013.01)

(58) Field of Classification Search
CPC ... G09G 2310/0256; G09G 2300/0819; G09G 2300/0842; G09G 2300/0866; G09G 2310/0205–021
USPC ..... 315/169.1–169.4; 345/76–84, 87–104, 345/204, 208–210
See application file for complete search history.

(56) References Cited

U.S. PATENT DOCUMENTS 4,090,096 A 5/1978 Nagami
4,160,934 A 7/1979 Kirsch
4,295,091 A 10/1981 Ponkala
4,354,162 A 10/1982 Wright
4,758,831 A 7/1988 Kasahara
4,943,956 A 7/1990 Noro
4,963,860 A 10/1990 Stewart
4,975,691 A 12/1990 Lee
4,996,523 A 2/1991 Bell
5,051,739 A 9/1991 Hayashida
5,153,420 A 10/1992 Hack
5,198,803 A 3/1993 Shie
5,204,661 A 4/1993 Hack
5,222,082 A 6/1993 Plus
5,266,515 A 11/1993 Robb
5,489,918 A 2/1996 Mosier
5,498,880 A 3/1996 Lee
5,557,342 A 9/1996 Eto
5,561,381 A 10/1996 Jenkins
5,572,444 A 11/1996 Lentz
5,589,847 A 12/1996 Lewis
5,619,033 A 4/1997 Weisfield
5,648,276 A 7/1997 Hara
5,670,973 A 9/1997 Bassetti
5,684,365 A 11/1997 Tang
5,686,935 A 11/1997 Weisbrod
5,691,783 A 11/1997 Numao
5,712,653 A 1/1998 Katoh
5,711,968 A 2/1998 Ikeda
5,723,950 A 3/1998 Wei
5,741,824 A 4/1998 Kousai
5,745,660 A 4/1998 Kolpatzik
5,747,928 A 5/1998 Shanks
5,748,160 A 5/1998 Shieh
5,784,042 A 7/1998 Ono
5,790,234 A 8/1998 Matsuyama
5,815,303 A 9/1998 Berlin
5,870,071 A 2/1999 Kawahata
5,874,803 A 2/1999 Garbuzov
5,880,582 A 3/1999 Sawada
5,903,248 A 5/1999 Irwin
5,917,280 A 6/1999 Burrows
5,923,794 A 7/1999 McGrath
5,945,972 A 8/1999 Okumura
5,949,398 A 9/1999 Kim
5,952,789 A 9/1999 Stewart
5,952,991 A 9/1999 Akiyama
5,982,104 A 11/1999 Sasaki
5,990,629 A 11/1999 Yamada
6,023,259 A 2/2000 Howard
6,069,365 A 5/2000 Chow
6,081,131 A 6/2000 Ishii
6,091,203 A 7/2000 Kawashima
6,097,360 A 8/2000 Holloman
6,144,222 A 11/2000 Ho
6,166,489 A 12/2000 Thompson
6,177,915 B1 1/2001 Beeteson
6,225,846 B1 5/2001 Wada
6,229,506 B1 5/2001 Dawson
6,229,508 B1 5/2001 Kane
6,232,939 B1 5/2001 Saito
6,246,180 B1 6/2001 Nishigaki
6,252,248 B1 6/2001 Sano
6,259,424 B1 7/2001 Kurogane
6,262,589 B1 7/2001 Tamukai
6,271,825 B1 8/2001 Greene
6,274,887 B1 8/2001 Yamazaki
6,288,696 B1 9/2001 Holloman
6,300,928 B1 10/2001 Kim
6,303,963 B1 10/2001 Ohtani
6,304,039 B1 10/2001 Appelberg
6,306,694 B1 10/2001 Yamazaki
6,307,322 B1 10/2001 Dawson
6,310,962 B1 10/2001 Chung
6,316,786 B1 11/2001 Mueller
6,320,325 B1 11/2001 Cok
6,323,631 B1 11/2001 Juang
6,323,832 B1 11/2001 Nishizawa
6,329,971 B2 12/2001 McKnight
6,345,085 B1 2/2002 Yeo
6,348,835 B1 2/2002 Sato
6,356,029 B1 3/2002 Hunter
6,365,917 B1 4/2002 Yamazaki
6,373,453 B1 4/2002 Yudasaka
6,373,454 B1 4/2002 Knapp
6,377,237 B1 4/2002 Sojourner
6,384,427 B1 5/2002 Yamazaki
6,392,617 B1 5/2002 Gleason
6,399,988 B1 6/2002 Yamazaki
6,404,139 B1 6/2002 Sasaki
6,414,661 B1 7/2002 Shen
6,417,825 B1 7/2002 Stewart
6,420,758 B1 7/2002 Nakajima
6,420,834 B2 7/2002 Yamazaki
6,420,988 B1 7/2002 Azami
6,433,488 B1 8/2002 Bu
6,437,106 B1 8/2002 Stoner
6,445,369 B1 9/2002 Yang
6,445,376 B2 9/2002 Parrish
6,468,638 B2 10/2002 Jacobsen
6,475,845 B2 11/2002 Kimura
6,489,952 B1 12/2002 Tanaka
6,501,098 B2 12/2002 Yamazaki
6,501,466 B1 12/2002 Yamagishi
6,512,271 B1 1/2003 Yamazaki
6,518,594 B1 2/2003 Nakajima
6,518,962 B2 2/2003 Kimura
6,522,315 B2 2/2003 Ozawa
6,524,895 B2 2/2003 Yamazaki
6,525,683 B1 2/2003 Gu
6,531,713 B1 3/2003 Yamazaki
6,531,827 B2 3/2003 Kawashima
6,541,921 B1 4/2003 Luciano, Jr.
6,542,138 B1 4/2003 Shannon
6,555,420 B1 4/2003 Yamazaki
6,559,594 B2 5/2003 Fukunaga
6,573,195 B1 6/2003 Yamazaki
6,573,584 B1 6/2003 Nagakari
6,576,926 B1 6/2003 Yamazaki
6,577,302 B2 6/2003 Hunter
6,580,408 B1 6/2003 Bae
6,580,657 B2 6/2003 Sanford
6,583,398 B2 6/2003 Harkin

(56) References Cited

U.S. PATENT DOCUMENTS 6,583,775 B1 6/2003 Sekiya
6,583,776 B2 6/2003 Yamazaki
6,593,691 B2 7/2003 Nishi
6,594,606 B2 7/2003 Everitt
6,597,203 B2 7/2003 Forbes
6,611,108 B2 8/2003 Kimura
6,617,644 B1 9/2003 Yamazaki
6,618,030 B2 9/2003 Kane
6,639,244 B1 10/2003 Yamazaki
6,641,933 B1 11/2003 Yamazaki
6,661,180 B2 12/2003 Koyoma
6,661,397 B2 12/2003 Mikami
6,668,645 B1 12/2003 Gilmour
6,670,637 B2 12/2003 Yamazaki
6,677,713 B1 1/2004 Sung
6,680,577 B1 1/2004 Inukai
6,680,580 B1 1/2004 Sung
6,687,266 B1 2/2004 Ma
6,690,000 B1 2/2004 Muramatsu
6,690,344 B1 2/2004 Takeuchi
6,693,388 B2 2/2004 Oomura
6,693,610 B2 2/2004 Shannon
6,697,057 B2 2/2004 Koyama
6,720,942 B2 4/2004 Lee
6,724,151 B2 4/2004 Yoo
6,734,636 B2 5/2004 Sanford
6,738,034 B2 5/2004 Kaneko
6,738,035 B1 5/2004 Fan
6,753,655 B2 6/2004 Shih
6,753,834 B2 6/2004 Mikami
6,756,741 B2 6/2004 Li
6,756,952 B1 6/2004 Decaux
6,756,958 B2 6/2004 Fumhashi
6,765,549 B1 7/2004 Yamazaki
6,771,028 B1 8/2004 Winters
6,777,712 B2 8/2004 Sanford
6,777,888 B2 8/2004 Kondo
6,780,687 B2 8/2004 Nakajima
6,781,567 B2 8/2004 Kimura
6,806,497 B2 10/2004 Jo
6,806,638 B2 10/2004 Lih
6,806,857 B2 10/2004 Sempel
6,809,706 B2 10/2004 Shimoda
6,815,975 B2 11/2004 Nara
6,828,950 B2 12/2004 Koyama
6,853,371 B2 2/2005 Miyajima
6,859,193 B1 2/2005 Yumoto
6,861,670 B1 3/2005 Ohtani
6,873,117 B2 3/2005 Ishizuka
6,873,320 B2 3/2005 Nakamura
6,876,346 B2 4/2005 Anzai
6,878,968 B1 4/2005 Ohnuma
6,885,356 B2 4/2005 Hashimoto
6,900,485 B2 5/2005 Lee
6,903,734 B2 6/2005 Eu
6,909,114 B1 6/2005 Yamazuki
6,909,243 B2 6/2005 Inukai
6,909,419 B2 6/2005 Zavracky
6,911,960 B1 6/2005 Yokoyama
6,911,964 B2 6/2005 Lee
6,914,448 B2 7/2005 Jinno
6,919,871 B2 7/2005 Kwon
6,924,602 B2 8/2005 Komiya
6,937,215 B2 8/2005 Lo
6,937,220 B2 8/2005 Kitaura
6,940,214 B1 9/2005 Komiya
6,943,500 B2 9/2005 LeChevalier
6,947,022 B2 9/2005 McCartney
6,954,194 B2 10/2005 Matsumoto
6,956,547 B2 10/2005 Bae
6,975,142 B2 12/2005 Azami
6,975,332 B2 12/2005 Arnold
6,995,510 B2 2/2006 Murakami
6,995,519 B2 2/2006 Arnold
7,022,556 B1 4/2006 Adachi
7,023,408 B2 4/2006 Chen
7,027,015 B2 4/2006 Booth, Jr.
7,027,078 B2 4/2006 Reihl
7,034,793 B2 4/2006 Sekiya
7,038,392 B2 5/2006 Libsch
7,053,875 B2 5/2006 Chou
7,057,359 B2 6/2006 Hung
7,061,451 B2 6/2006 Kimura
7,064,733 B2 6/2006 Cok
7,071,932 B2 7/2006 Libsch
7,088,051 B1 8/2006 Cok
7,088,052 B2 8/2006 Kimura
7,102,378 B2 9/2006 Kuo
7,106,285 B2 9/2006 Naugler
7,112,820 B2 9/2006 Change
7,116,058 B2 10/2006 Lo
7,119,493 B2 10/2006 Fryer
7,122,835 B1 10/2006 Ikeda
7,127,380 B1 10/2006 Iverson
7,129,914 B2 10/2006 Knapp
7,129,917 B2 10/2006 Yamazaki
7,141,821 B1 11/2006 Yamazaki
7,161,566 B2 1/2007 Cok
7,164,417 B2 1/2007 Cok
7,193,589 B2 3/2007 Yoshida
7,199,516 B2 4/2007 Seo
7,220,997 B2 5/2007 Nakata
7,224,332 B2 5/2007 Cok
7,227,519 B1 6/2007 Kawase
7,235,810 B1 6/2007 Yamazaki
7,245,277 B2 7/2007 Ishizuka
7,246,912 B2 7/2007 Burger
7,248,236 B2 7/2007 Nathan
7,262,753 B2 8/2007 Tanghe
7,264,979 B2 9/2007 Yamagata
7,274,345 B2 9/2007 Imamura
7,274,363 B2 9/2007 Ishizuka
7,279,711 B1 10/2007 Yamazaki
7,304,621 B2 12/2007 Oomori
7,310,092 B2 12/2007 Imamura
7,315,295 B2 1/2008 Kimura
7,317,429 B2 1/2008 Shirasaki
7,319,465 B2 1/2008 Mikami
7,321,348 B2 1/2008 Cok
7,339,560 B2 3/2008 Sun
7,339,636 B2 3/2008 Voloschenko
7,355,574 B1 4/2008 Leon
7,358,941 B2 4/2008 Ono
7,368,868 B2 5/2008 Sakamoto
7,397,485 B2 7/2008 Miller
7,402,467 B1 7/2008 Kadono
7,411,571 B2 8/2008 Huh
7,414,600 B2 8/2008 Nathan
7,423,617 B2 9/2008 Giraldo
7,432,885 B2 10/2008 Asano
7,453,054 B2 11/2008 Lee
7,474,285 B2 1/2009 Kimura
7,485,478 B2 2/2009 Yamagata
7,502,000 B2 3/2009 Yuki
7,528,812 B2 5/2009 Tsuge
7,535,449 B2 5/2009 Miyazawa
7,554,512 B2 6/2009 Steer
7,569,849 B2 8/2009 Nathan
7,576,718 B2 8/2009 Miyazawa
7,580,012 B2 8/2009 Kim
7,589,707 B2 9/2009 Chou
7,605,792 B2 10/2009 Son
7,609,239 B2 10/2009 Chang
7,619,594 B2 11/2009 Hu
7,619,597 B2 11/2009 Nathan
7,633,470 B2 12/2009 Kane
7,656,370 B2 2/2010 Schneider
7,675,485 B2 3/2010 Steer
7,697,052 B1 4/2010 Yamazaki
7,800,558 B2 9/2010 Routley
7,825,419 B2 11/2010 Yamagata
7,847,764 B2 12/2010 Cok
7,859,492 B2 12/2010 Kolmo
7,868,859 B2 1/2011 Tomida

(56) References Cited

U.S. PATENT DOCUMENTS 7,876,294 B2 1/2011 Sasaki
7,924,249 B2 4/2011 Nathan
7,932,883 B2 4/2011 Klompenhouwer
7,948,170 B2 5/2011 Striakhilev
7,969,390 B2 6/2011 Yoshida
7,978,187 B2 7/2011 Nathan
7,994,712 B2 8/2011 Sung
7,995,010 B2 8/2011 Yamazaki
8,026,876 B2 9/2011 Nathan
8,031,180 B2 10/2011 Miyamoto
8,044,893 B2 10/2011 Nathan
8,049,420 B2 11/2011 Tamura
8,077,123 B2 12/2011 Naugler, Jr.
8,115,707 B2 2/2012 Nathan
8,208,084 B2 6/2012 Lin
8,223,177 B2 7/2012 Nathan
8,232,939 B2 7/2012 Nathan
8,259,044 B2 9/2012 Nathan
8,264,431 B2 9/2012 Bulovic
8,279,143 B2 10/2012 Nathan
8,294,696 B2 10/2012 Min
8,314,783 B2 11/2012 Sambandan
8,339,386 B2 12/2012 Leon
8,378,362 B2 2/2013 Heo
8,441,206 B2 5/2013 Myers
8,493,295 B2 7/2013 Yamazaki
8,493,296 B2 7/2013 Ogawa
8,497,525 B2 7/2013 Yamagata
8,581,809 B2 11/2013 Nathan
9,125,278 B2 9/2015 Nathan
2001/0002703 A1 6/2001 Koyama
2001/0004190 A1 6/2001 Nishi
2001/0004252 A1 6/2001 Park
2001/0009283 A1 7/2001 Arao
2001/0013806 A1 8/2001 Notani
2001/0015653 A1 8/2001 De Jong
2001/0020926 A1 9/2001 Kujik
2001/0022565 A1* 9/2001 Kimura ..... G09G 3/3266 345/82
2001/0024181 A1 9/2001 Kubota
2001/0024186 A1 9/2001 Kane
2001/0026127 A1 10/2001 Yoneda
2001/0026179 A1 10/2001 Saeki
2001/0026257 A1* 10/2001 Kimura ..... G09G 3/2022 345/87
2001/0026725 A1 10/2001 Petteruti et al.
2001/0030323 A1 10/2001 Ikeda
2001/0033199 A1 10/2001 Aoki
2001/0035863 A1 11/2001 Kimura
2001/0038098 A1 11/2001 Yamazaki
2001/0038367 A1 11/2001 Inukai
2001/0040541 A1 11/2001 Yoneda
2001/0043173 A1 11/2001 Troutman
2001/0045929 A1 11/2001 Prache
2001/0052606 A1 12/2001 Sempel
2001/0052898 A1 12/2001 Osame
2001/0052940 A1 12/2001 Hagihara
2002/0000576 A1 1/2002 Inukai
2002/0011796 A1 1/2002 Koyama
2002/0011799 A1 1/2002 Kimura
2002/0011981 A1 1/2002 Kujik
2002/0012057 A1 1/2002 Kimura
2002/0014851 A1 2/2002 Tai
2002/0015031 A1 2/2002 Fujita
2002/0015032 A1 2/2002 Koyoma
2002/0018034 A1 2/2002 Ohki
2002/0030190 A1 3/2002 Ohtani
2002/0030528 A1 3/2002 Matsumoto
2002/0030647 A1 3/2002 Hack
2002/0036463 A1 3/2002 Yoneda
2002/0047565 A1 4/2002 Nara
2002/0047852 A1 4/2002 Inukai
2002/0048829 A1 4/2002 Yamazaki
2002/0050795 A1 5/2002 Miura
2002/0052086 A1 5/2002 Maeda
2002/0053401 A1 5/2002 Ishikawa
2002/0067134 A1 6/2002 Kawashima
2002/0070909 A1 6/2002 Asano
2002/0080108 A1 6/2002 Wang
2002/0084463 A1 7/2002 Sanford
2002/0089474 A1 7/2002 Wu
2002/0101152 A1 8/2002 Kimura
2002/0101172 A1 8/2002 Bu
2002/0101433 A1 8/2002 McKnight
2002/0105279 A1 8/2002 Kimura
2002/0113248 A1 8/2002 Yamagata
2002/0117722 A1 8/2002 Osada
2002/0122308 A1 9/2002 Ikeda
2002/0130686 A1 9/2002 Forbes
2002/0154084 A1 10/2002 Tanaka
2002/0158587 A1 10/2002 Komiya
2002/0158666 A1 10/2002 Azarni
2002/0158823 A1 10/2002 Zavracky
2002/0163314 A1 11/2002 Yamazaki
2002/0167471 A1 11/2002 Everitt
2002/0167474 A1 11/2002 Everitt
2002/0169575 A1 11/2002 Everitt
2002/0180369 A1 12/2002 Koyama
2002/0180721 A1 12/2002 Kimura
2002/0181276 A1 12/2002 Yamazaki
2002/0183945 A1 12/2002 Everitt
2002/0186214 A1 12/2002 Siwinski
2002/0190332 A1 12/2002 Lee
2002/0190924 A1 12/2002 Asano
2002/0190971 A1 12/2002 Nakamura
2002/0195967 A1 12/2002 Kim
2002/0195968 A1 12/2002 Sanford
2003/0020413 A1 1/2003 Oomura
2003/0030603 A1 2/2003 Shimoda
2003/0043088 A1 3/2003 Booth
2003/0057895 A1 3/2003 Kimura
2003/0058226 A1 3/2003 Bertram
2003/0062524 A1 4/2003 Kimura
2003/0063081 A1 4/2003 Kimura
2003/0071821 A1 4/2003 Sundahl
2003/0076048 A1 4/2003 Rutherford
2003/0090445 A1 5/2003 Chen
2003/0090447 A1 5/2003 Kimura
2003/0090481 A1 5/2003 Kimura
2003/0095087 A1 5/2003 Libsch
2003/0107560 A1 6/2003 Yumoto
2003/0111966 A1 6/2003 Mikami
2003/0122745 A1 7/2003 Miyazawa
2003/0122749 A1 7/2003 Booth, Jr.
2003/0122813 A1 7/2003 Ishizuki
2003/0140958 A1 7/2003 Yang
2003/0142088 A1 7/2003 LeChevalier
2003/0146897 A1 8/2003 Hunter
2003/0151569 A1 8/2003 Lee
2003/0156101 A1 8/2003 LeChevalier
2003/0160745 A1* 8/2003 Osame ..... G09G 3/3258 345/82
2003/0169219 A1 9/2003 LeChevalier
2003/0169241 A1 9/2003 LeChevalier
2003/0174152 A1 9/2003 Noguchi
2003/0179626 A1 9/2003 Sanford
2003/0185438 A1 10/2003 Osawa
2003/0197663 A1 10/2003 Lee
2003/0206060 A1 11/2003 Suzuki
2003/0210256 A1 11/2003 Mori
2003/0230141 A1 12/2003 Gilmour
2003/0230980 A1 12/2003 Forrest
2003/0231148 A1 12/2003 Lin
2004/0027063 A1 2/2004 Nishikawa
2004/0032382 A1 2/2004 Cok
2004/0036664 A1 2/2004 Miyazaw
2004/0041750 A1 3/2004 Abe
2004/0056604 A1 3/2004 Shih
2004/0066357 A1 4/2004 Kawasaki
2004/0070557 A1 4/2004 Asano
2004/0070565 A1 4/2004 Nayar
2004/0080262 A1 4/2004 Park
2004/0080470 A1 4/2004 Yamazaki
2004/0090186 A1 5/2004 Kanauchi

(56) References Cited

U.S. PATENT DOCUMENTS

2004/0090400 A1 5/2004 Yoo
2004/0095297 A1 5/2004 Libsch
2004/0100427 A1 5/2004 Miyazawa
2004/0108518 A1 6/2004 Jo
2004/0113903 A1 6/2004 Mikami
2004/0129933 A1 7/2004 Nathan
2004/0130516 A1 7/2004 Nathan
2004/0135749 A1 7/2004 Kondakov
2004/0140982 A1 7/2004 Pate
2004/0145547 A1 7/2004 Oh
2004/0150592 A1 8/2004 Mizukoshi
2004/0150594 A1 8/2004 Koyama
2004/0150595 A1 8/2004 Kasai
2004/0155841 A1 8/2004 Kasai
2004/0174347 A1 9/2004 Sun
2004/0174349 A1 9/2004 Libsch
2004/0174354 A1 9/2004 Ono
2004/0178743 A1 9/2004 Miller
2004/0183759 A1 9/2004 Stevenson
2004/0189627 A1 9/2004 Shirasaki
2004/0196275 A1 10/2004 Hattori
2004/0201554 A1 10/2004 Satoh
2004/0207615 A1 10/2004 Yumoto
2004/0227697 A1 11/2004 Mori
2004/0233125 A1 11/2004 Tanghe
2004/0239596 A1 12/2004 Ono
2004/0246246 A1 12/2004 Tobita
2004/0252089 A1 12/2004 Ono
2004/0257313 A1 12/2004 Kawashima
2004/0257353 A1 12/2004 Imamura
2004/0257355 A1 12/2004 Naugler
2004/0263437 A1 12/2004 Hattori
2004/0263444 A1 12/2004 Kimura
2004/0263445 A1 12/2004 Inukai
2004/0263541 A1 12/2004 Takeuchi
2005/0007355 A1 1/2005 Miura
2005/0007357 A1 1/2005 Yamashita
2005/0007392 A1 1/2005 Kasai
2005/0017650 A1 1/2005 Fryer
2005/0024081 A1 2/2005 Kuo
2005/0024393 A1 2/2005 Kondo
2005/0030267 A1 2/2005 Tanghe
2005/0035709 A1 2/2005 Fumie
2005/0057484 A1 3/2005 Diefenbaugh
2005/0057580 A1 3/2005 Yamano
2005/0067970 A1 3/2005 Libsch
2005/0067971 A1 3/2005 Kane
2005/0068270 A1 3/2005 Awakura
2005/0068275 A1 3/2005 Kane
2005/0073264 A1 4/2005 Matsumoto
2005/0083323 A1 4/2005 Suzuki
2005/0088103 A1 4/2005 Kageyama
2005/0105031 A1 5/2005 Shih
2005/0110420 A1 5/2005 Arnold
2005/0110807 A1 5/2005 Chang
2005/0117096 A1 6/2005 Voloschenko
2005/0122294 A1 6/2005 Ben-David
2005/0140598 A1 6/2005 Kim
2005/0140610 A1 6/2005 Smith
2005/0145891 A1 7/2005 Abe
2005/0156831 A1 7/2005 Yamazaki
2005/0157581 A1 7/2005 Shimasaki
2005/0162079 A1 7/2005 Sakamoto
2005/0168416 A1 8/2005 Hashimoto
2005/0179626 A1 8/2005 Yuki
2005/0179628 A1 8/2005 Kimura
2005/0185200 A1 8/2005 Tobol
2005/0200575 A1 9/2005 Kim
2005/0206590 A1 9/2005 Sasaki
2005/0212787 A1 9/2005 Noguchi
2005/0219184 A1 10/2005 Zehner
2005/0225683 A1 10/2005 Nozawa
2005/0225686 A1 10/2005 Bmmmack
2005/0248515 A1 11/2005 Naugler
2005/0269959 A1 12/2005 Uchino
2005/0269960 A1 12/2005 Ono
2005/0280613 A1 12/2005 Takei
2005/0280615 A1 12/2005 Cok
2005/0280766 A1 12/2005 Johnson
2005/0285822 A1 12/2005 Reddy
2005/0285825 A1 12/2005 Eom
2006/0001613 A1 1/2006 Routley
2006/0007072 A1 1/2006 Choi
2006/0007206 A1 1/2006 Reddy
2006/0007249 A1 1/2006 Reddy
2006/0012310 A1 1/2006 Chen
2006/0012311 A1 1/2006 Ogawa
2006/0015272 A1 1/2006 Giraldo
2006/0022305 A1 2/2006 Yamashita
2006/0022907 A1 2/2006 Uchino
2006/0027807 A1 2/2006 Nathan
2006/0030084 A1 2/2006 Young
2006/0038501 A1 2/2006 Koyama
2006/0038758 A1 2/2006 Routley
2006/0038762 A1 2/2006 Chou
2006/0044227 A1 3/2006 Hadcock
2006/0061248 A1 3/2006 Cok
2006/0066527 A1 3/2006 Chou
2006/0066533 A1 3/2006 Sato
2006/0077134 A1 4/2006 Hector
2006/0077135 A1 4/2006 Cok
2006/0077142 A1 4/2006 Kwon
2006/0082523 A1 4/2006 Guo
2006/0092185 A1 5/2006 Jo
2006/0097628 A1 5/2006 Suh
2006/0097631 A1 5/2006 Lee
2006/0103324 A1 5/2006 Kim
2006/0103611 A1 5/2006 Choi
2006/0125740 A1 6/2006 Shirasaki
2006/0149493 A1 7/2006 Sambandan
2006/0170623 A1 8/2006 Naugler, Jr.
2006/0176250 A1 8/2006 Nathan
2006/0208961 A1 9/2006 Nathan
2006/0208971 A1 9/2006 Deane
2006/0214888 A1 9/2006 Schneider
2006/0231740 A1 10/2006 Kasai
2006/0232522 A1 10/2006 Roy
2006/0244697 A1 11/2006 Lee
2006/0256048 A1 11/2006 Fish
2006/0261841 A1 11/2006 Fish
2006/0264143 A1 11/2006 Lee
2006/0273997 A1 12/2006 Nathan
2006/0279481 A1 12/2006 Haruna
2006/0284801 A1 12/2006 Yoon
2006/0284802 A1 12/2006 Kohno
2006/0284895 A1 12/2006 Marcu
2006/0290614 A1 12/2006 Nathan
2006/0290618 A1 12/2006 Goto
2007/0001937 A1 1/2007 Park
2007/0001939 A1 1/2007 Hashimoto
2007/0008251 A1 1/2007 Kohno
2007/0008268 A1 1/2007 Park
2007/0008297 A1 1/2007 Bassetti
2007/0057873 A1 3/2007 Uchino
2007/0057874 A1 3/2007 LeRoy
2007/0069998 A1 3/2007 Naugler
2007/0075727 A1 4/2007 Nakano
2007/0076226 A1 4/2007 Klompenhouwer
2007/0080905 A1 4/2007 Takahara
2007/0080906 A1 4/2007 Tanabe
2007/0080908 A1 4/2007 Nathan
2007/0080918 A1 4/2007 Kawachi
2007/0097038 A1 5/2007 Yamazaki
2007/0097041 A1 5/2007 Park
2007/0103411 A1 5/2007 Cok
2007/0103419 A1 5/2007 Uchino
2007/0115221 A1 5/2007 Buchhauser
2007/0126672 A1 6/2007 Tada
2007/0164664 A1 7/2007 Ludwicki
2007/0164937 A1 7/2007 Jung
2007/0164938 A1 7/2007 Shin
2007/0182671 A1 8/2007 Nathan
2007/0236134 A1 10/2007 Ho
2007/0236440 A1 10/2007 Wacyk

(56) References Cited

U.S. PATENT DOCUMENTS

| | | | |
|---|---|---|---|
| 2007/0236517 | A1 | 10/2007 | Kimpe |
| 2007/0241999 | A1 | 10/2007 | Lin |
| 2007/0273294 | A1 | 11/2007 | Nagayama |
| 2007/0285359 | A1 | 12/2007 | Ono |
| 2007/0290957 | A1 | 12/2007 | Cok |
| 2007/0290958 | A1 | 12/2007 | Cok |
| 2007/0296672 | A1 | 12/2007 | Kim |
| 2008/0001525 | A1 | 1/2008 | Chao |
| 2008/0001544 | A1 | 1/2008 | Murakami |
| 2008/0030518 | A1 | 2/2008 | Higgins |
| 2008/0036706 | A1 | 2/2008 | Kitazawa |
| 2008/0036708 | A1 | 2/2008 | Shirasaki |
| 2008/0042942 | A1 | 2/2008 | Takahashi |
| 2008/0042948 | A1 | 2/2008 | Yamashita |
| 2008/0048951 | A1 | 2/2008 | Naugler, Jr. |
| 2008/0055209 | A1 | 3/2008 | Cok |
| 2008/0055211 | A1 | 3/2008 | Ogawa |
| 2008/0074413 | A1 | 3/2008 | Ogura |
| 2008/0088549 | A1 | 4/2008 | Nathan |
| 2008/0088648 | A1 | 4/2008 | Nathan |
| 2008/0111766 | A1 | 5/2008 | Uchino |
| 2008/0116787 | A1 | 5/2008 | Hsu |
| 2008/0117144 | A1 | 5/2008 | Nakano |
| 2008/0136770 | A1 | 6/2008 | Peker |
| 2008/0150845 | A1 | 6/2008 | Ishii |
| 2008/0150847 | A1 | 6/2008 | Kim |
| 2008/0158115 | A1 | 7/2008 | Cordes |
| 2008/0158648 | A1 | 7/2008 | Cummings |
| 2008/0191976 | A1 | 8/2008 | Nathan |
| 2008/0198103 | A1 | 8/2008 | Toyomura |
| 2008/0211749 | A1 | 9/2008 | Weitbmch |
| 2008/0218451 | A1 | 9/2008 | Miyamoto |
| 2008/0231558 | A1 | 9/2008 | Naugler |
| 2008/0231562 | A1 | 9/2008 | Kwon |
| 2008/0231625 | A1 | 9/2008 | Minami |
| 2008/0246713 | A1 | 10/2008 | Lee |
| 2008/0252223 | A1 | 10/2008 | Toyoda |
| 2008/0252571 | A1 | 10/2008 | Hente |
| 2008/0259020 | A1 | 10/2008 | Fisekovic |
| 2008/0290805 | A1 | 11/2008 | Yamada |
| 2008/0297055 | A1 | 12/2008 | Miyake |
| 2009/0032807 | A1 | 2/2009 | Shinohara |
| 2009/0033598 | A1 | 2/2009 | Suh |
| 2009/0058772 | A1 | 3/2009 | Lee |
| 2009/0109142 | A1 | 4/2009 | Takahara |
| 2009/0121994 | A1 | 5/2009 | Miyata |
| 2009/0146926 | A1 | 6/2009 | Sung |
| 2009/0160743 | A1 | 6/2009 | Tornida |
| 2009/0174628 | A1 | 7/2009 | Wang |
| 2009/0184901 | A1 | 7/2009 | Kwon |
| 2009/0195483 | A1 | 8/2009 | Naugler, Jr. |
| 2009/0201281 | A1 | 8/2009 | Routley |
| 2009/0206764 | A1 | 8/2009 | Schemmann |
| 2009/0207160 | A1 | 8/2009 | Shirasaki |
| 2009/0213046 | A1 | 8/2009 | Nam |
| 2009/0244046 | A1 | 10/2009 | Seto |
| 2009/0262047 | A1 | 10/2009 | Yamashita |
| 2010/0004891 | A1 | 1/2010 | Ahlers |
| 2010/0026725 | A1 | 2/2010 | Smith |
| 2010/0039422 | A1 | 2/2010 | Seto |
| 2010/0039458 | A1 | 2/2010 | Nathan |
| 2010/0045646 | A1 | 2/2010 | Kishi |
| 2010/0045650 | A1 | 2/2010 | Fish |
| 2010/0060911 | A1 | 3/2010 | Marcu |
| 2010/0073335 | A1 | 3/2010 | Min |
| 2010/0073357 | A1 | 3/2010 | Min |
| 2010/0079419 | A1 | 4/2010 | Shibusawa |
| 2010/0079711 | A1 | 4/2010 | Tanaka |
| 2010/0085282 | A1 | 4/2010 | Yu |
| 2010/0103160 | A1 | 4/2010 | Jeon |
| 2010/0134469 | A1 | 6/2010 | Ogura |
| 2010/0134475 | A1 | 6/2010 | Ogura |
| 2010/0165002 | A1 | 7/2010 | Ahn |
| 2010/0194670 | A1 | 8/2010 | Cok |
| 2010/0207960 | A1 | 8/2010 | Kimpe |
| 2010/0225630 | A1 | 9/2010 | Levey |
| 2010/0251295 | A1 | 9/2010 | Amento |
| 2010/0277400 | A1 | 11/2010 | Jeong |
| 2010/0315319 | A1 | 12/2010 | Cok |
| 2010/0328294 | A1 | 12/2010 | Sasaki |
| 2011/0050870 | A1 | 3/2011 | Hanari |
| 2011/0063197 | A1 | 3/2011 | Chung |
| 2011/0069051 | A1 | 3/2011 | Nakamura |
| 2011/0069089 | A1 | 3/2011 | Kopf |
| 2011/0069096 | A1 | 3/2011 | Li |
| 2011/0074750 | A1 | 3/2011 | Leon |
| 2011/0074762 | A1 | 3/2011 | Shirasaki |
| 2011/0090210 | A1 | 4/2011 | Sasaki |
| 2011/0149166 | A1 | 6/2011 | Botzas |
| 2011/0169798 | A1 | 7/2011 | Lee |
| 2011/0175895 | A1 | 7/2011 | Hayakawa |
| 2011/0181630 | A1 | 7/2011 | Smith |
| 2011/0199395 | A1 | 8/2011 | Nathan |
| 2011/0227964 | A1 | 9/2011 | Chaji |
| 2011/0242074 | A1 | 10/2011 | Bert |
| 2011/0273399 | A1 | 11/2011 | Lee |
| 2011/0279488 | A1 | 11/2011 | Nathan |
| 2011/0292006 | A1 | 12/2011 | Kim |
| 2011/0293480 | A1 | 12/2011 | Mueller |
| 2012/0056558 | A1 | 3/2012 | Toshiya |
| 2012/0062565 | A1 | 3/2012 | Fuchs |
| 2012/0262184 | A1 | 10/2012 | Shen |
| 2012/0299970 | A1 | 11/2012 | Bae |
| 2012/0299973 | A1 | 11/2012 | Jaffari |
| 2012/0299978 | A1 | 11/2012 | Chaji |
| 2013/0002527 | A1 | 1/2013 | Kim |
| 2013/0027381 | A1 | 1/2013 | Nathan |
| 2013/0032831 | A1 | 2/2013 | Chaji |
| 2013/0057595 | A1 | 3/2013 | Nathan |
| 2013/0112960 | A1 | 5/2013 | Chaji |
| 2013/0135272 | A1 | 5/2013 | Park |
| 2013/0162617 | A1 | 6/2013 | Yoon |
| 2013/0201223 | A1 | 8/2013 | Li |
| 2013/0241813 | A1 | 9/2013 | Tanaka |
| 2013/0309821 | A1 | 11/2013 | Yoo |
| 2013/0321671 | A1 | 12/2013 | Cote |
| 2014/0015824 | A1 | 1/2014 | Chaji |
| 2014/0022289 | A1 | 1/2014 | Lee |
| 2014/0043316 | A1 | 2/2014 | Chaji |
| 2014/0055500 | A1 | 2/2014 | Lai |
| 2014/0111567 | A1 | 4/2014 | Nathan |
| 2016/0275860 | A1 | 9/2016 | Wu |

FOREIGN PATENT DOCUMENTS

| | | |
|---|---|---|
| CA | 2 249 592 | 7/1998 |
| CA | 2 368 386 | 9/1999 |
| CA | 2 242 720 | 1/2000 |
| CA | 2 354 018 | 6/2000 |
| CA | 2 432 530 | 7/2002 |
| CA | 2 436 451 | 8/2002 |
| CA | 2 438 577 | 8/2002 |
| CA | 2 483 645 | 12/2003 |
| CA | 2 463 653 | 1/2004 |
| CA | 2 498 136 | 3/2004 |
| CA | 2 522 396 | 11/2004 |
| CA | 2 443 206 | 3/2005 |
| CA | 2 472 671 | 12/2005 |
| CA | 2 567 076 | 1/2006 |
| CA | 2526436 | 2/2006 |
| CA | 2 526 782 | 4/2006 |
| CA | 2541531 | 7/2006 |
| CA | 2 550 102 | 4/2008 |
| CA | 2 773 699 | 10/2013 |
| CN | 1381032 | 11/2002 |
| CN | 1448908 | 10/2003 |
| CN | 1682267 A | 10/2005 |
| CN | 1758309 A | 4/2006 |
| CN | 1760945 | 4/2006 |
| CN | 1886774 | 12/2006 |
| CN | 101194300 A | 6/2008 |
| CN | 101449311 | 6/2009 |
| CN | 101615376 | 12/2009 |
| CN | 102656621 | 9/2012 |

(56) References Cited

FOREIGN PATENT DOCUMENTS

| | | | |
|---|---|---|---|
| CN | 102725786 | A | 10/2012 |
| DE | 20 2006 005427 | | 6/2006 |
| EP | 0 158 366 | | 10/1985 |
| EP | 0 940 796 | | 9/1999 |
| EP | 1028471 | | 8/2000 |
| EP | 1 103 947 | | 5/2001 |
| EP | 1111 577 | | 6/2001 |
| EP | 1 130 565 | A1 | 9/2001 |
| EP | 1184 833 | | 3/2002 |
| EP | 1194 013 | | 4/2002 |
| EP | 1310 939 | | 5/2003 |
| EP | 1335 430 | A1 | 8/2003 |
| EP | 1372136 | | 12/2003 |
| EP | 1381 019 | | 1/2004 |
| EP | 1418 566 | | 5/2004 |
| EP | 1429 312 | A | 6/2004 |
| EP | 1439 520 | | 7/2004 |
| EP | 1450 341 | A | 8/2004 |
| EP | 1465 143 | A | 10/2004 |
| EP | 1467 408 | | 10/2004 |
| EP | 1469 448 | A | 10/2004 |
| EP | 1517290 | | 3/2005 |
| EP | 1 521 203 | A1 | 4/2005 |
| EP | 1594347 | | 11/2005 |
| EP | 1 784 055 | A2 | 5/2007 |
| EP | 1854338 | A1 | 11/2007 |
| EP | 1 879 169 | A1 | 1/2008 |
| EP | 1879172 | | 1/2008 |
| EP | 2395499 | A1 | 12/2011 |
| GB | 2 205 431 | | 12/1988 |
| GB | 2 389 951 | | 12/2003 |
| JP | 1272298 | | 10/1989 |
| JP | 4-042619 | | 2/1992 |
| JP | 6-314977 | | 11/1994 |
| JP | 8-340243 | | 12/1996 |
| JP | 09-090405 | | 4/1997 |
| JP | 10-153759 | | 6/1998 |
| JP | 10-254410 | | 9/1998 |
| JP | 11-202295 | | 7/1999 |
| JP | 11-219146 | | 8/1999 |
| JP | 11 231805 | | 8/1999 |
| JP | 11-282419 | | 10/1999 |
| JP | 2000-056847 | | 2/2000 |
| JP | 2000-077192 | | 3/2000 |
| JP | 2000-081607 | | 3/2000 |
| JP | 2000-089198 | | 3/2000 |
| JP | 2000-352941 | | 12/2000 |
| JP | 2001-134217 | | 5/2001 |
| JP | 2001-195014 | | 7/2001 |
| JP | 2002-055654 | | 2/2002 |
| JP | 2002-91376 | | 3/2002 |
| JP | 2002-514320 | | 5/2002 |
| JP | 2002-229513 | | 8/2002 |
| JP | 2002-268576 | | 9/2002 |
| JP | 2002-278513 | | 9/2002 |
| JP | 2002-333862 | | 11/2002 |
| JP | 2003-022035 | | 1/2003 |
| JP | 2003-076331 | | 3/2003 |
| JP | 2003-124519 | | 4/2003 |
| JP | 2003-150082 | | 5/2003 |
| JP | 2003-177709 | | 6/2003 |
| JP | 2003-271095 | | 9/2003 |
| JP | 2003-308046 | | 10/2003 |
| JP | 2003-317944 | | 11/2003 |
| JP | 2004-004675 | | 1/2004 |
| JP | 2004-045648 | | 2/2004 |
| JP | 2004-145197 | | 5/2004 |
| JP | 2004-287345 | | 10/2004 |
| JP | 2005-057217 | | 3/2005 |
| JP | 2007-065015 | | 3/2007 |
| JP | 2007-155754 | | 6/2007 |
| JP | 2008-102335 | | 5/2008 |
| JP | 4-158570 | | 10/2008 |
| JP | 2003-195813 | | 7/2013 |
| KR | 2004-0100887 | | 12/2004 |
| TW | 342486 | | 10/1998 |
| TW | 473622 | | 1/2002 |
| TW | 485337 | | 5/2002 |
| TW | 502233 | | 9/2002 |
| TW | 538650 | | 6/2003 |
| TW | 569173 | | 1/2004 |
| TW | 1221268 | | 9/2004 |
| TW | 1223092 | | 11/2004 |
| TW | 200727247 | | 7/2007 |
| WO | WO 1994/25954 | | 11/1994 |
| WO | WO 1998/48403 | | 10/1998 |
| WO | WO 1999/48079 | | 9/1999 |
| WO | WO 2001/06484 | | 1/2001 |
| WO | WO 2001/27910 | A1 | 4/2001 |
| WO | WO 2001/63587 | A2 | 8/2001 |
| WO | WO 2002/067327 | A | 8/2002 |
| WO | WO 2003/001496 | A1 | 1/2003 |
| WO | WO 2003/034389 | A | 4/2003 |
| WO | WO 2003/058594 | A1 | 7/2003 |
| WO | WO 2003/063124 | | 7/2003 |
| WO | WO 2003/077231 | | 9/2003 |
| WO | WO 2003/105117 | | 12/2003 |
| WO | WO 2004/003877 | | 1/2004 |
| WO | WO 2004/025615 | A | 3/2004 |
| WO | WO 2004/034364 | | 4/2004 |
| WO | WO 2004/047058 | | 6/2004 |
| WO | WO 2004/066249 | A1 | 8/2004 |
| WO | WO 2004/104975 | A1 | 12/2004 |
| WO | WO 2005/022498 | | 3/2005 |
| WO | WO 2005/022500 | A | 3/2005 |
| WO | WO 2005/029455 | | 3/2005 |
| WO | WO 2005/029456 | | 3/2005 |
| WO | WO/2005/034072 | a1 | 4/2005 |
| WO | WO 2005/055185 | | 6/2005 |
| WO | WO 2006/000101 | A1 | 1/2006 |
| WO | WO 2006/053424 | | 5/2006 |
| WO | WO 2006/063448 | A | 6/2006 |
| WO | WO 2006/084360 | | 8/2006 |
| WO | WO 2006/137337 | | 12/2006 |
| WO | WO 2007/003877 | A | 1/2007 |
| WO | WO 2007/079572 | | 7/2007 |
| WO | WO 2007/120849 | A2 | 10/2007 |
| WO | WO 2009/048618 | | 4/2009 |
| WO | WO 2009/055920 | | 5/2009 |
| WO | WO 2010/023270 | | 3/2010 |
| WO | WO 2010/146707 | A1 | 12/2010 |
| WO | WO 2011/041224 | A1 | 4/2011 |
| WO | WO 2011/064761 | A1 | 6/2011 |
| WO | WO 2011/067729 | | 6/2011 |
| WO | WO 2012/160424 | A1 | 11/2012 |
| WO | WO 2012/160471 | | 11/2012 |
| WO | WO 2012/164474 | A2 | 12/2012 |
| WO | WO 2012/164475 | A2 | 12/2012 |

OTHER PUBLICATIONS

Alexander : "Pixel circuits and drive schemes for glass and elastic AMOLED displays"; dated Jul. 2005 (9 pages).

Alexander: Unique Electrical Measurement Technology for Compensation, Inspection, and Process Diagnostics of AMOLED HDTV; dated May 2010 (4 pages).

Ashtiani: "AMOLED Pixel Circuit With Electronic Compensation of Luminance Degradation"; dated Mar. 2007 (4 pages).

Chaji: "A Current-Mode Comparator for Digital Calibration of Amorphous Silicon AMOLED Displays"; dated Jul. 2008 (5 pages).

Chaji : "A fast settling current driver based on the CCII for AMOLED displays"; dated Dec. 2009 (6 pages).

Chaji: "A Low-Cost Stable Amorphous Silicon AMOLED Display with Full V-T- and V-O-L-E-D Shift Compensation"; dated May 2007 (4 pages).

Chaji : "A low-power driving scheme for a-Si:H active-matrix organic light-emitting diode displays"; dated Jun. 2005 (4 pages).

Chaji : "A low-power high-performance digital circuit for deep submicron technologies": dated Jun. 2005 (4 pages).

Chaji : "A novel a-Si:H AMOLED pixel circuit based on short-term stress stability of a-Si:H TFTs"; dated Oct. 2005 (3 pages).

(56) References Cited

OTHER PUBLICATIONS

Chaji: "A Novel Driving Scheme and Pixel Circuit for AMOLED Displays"; dated Jun. 2006 (4 pages).
Chaji : "A Novel Driving Scheme for High Resolution Large-area a-SI:H AMOLED displays"; dated Aug. 2005 (3 pages).
Chaji: "A Stable Voltage-Programmed Pixel Circuit for a-Si:H AMOLED Displays"; dated Dec. 2006 (12 pages).
Chaji: "A Sub-μA fast-settling current-programmed pixel circuit for AMOLED displays"; dated Sep. 2007.
Chaji : "An Enhanced and Simplified Optical Feedback Pixel Circuit for AMOLED Displays"; dated Oct. 2006.
Chaji : "Compensation technique for DC and transient instability of thin film transistor circuits for large-area devices"; dated Aug. 2008.
Chaji : "Driving scheme for stable operation of 2-TFT a-Si AMOLED pixel"; dated Apr. 2005 (2 pages).
Chaji : "Dynamic-effect compensating technique for stable a-Si:H AMOLED displays"; dated Aug. 2005 (4 pages).
Chaji: "Electrical Compensation ofOLED Luminance Degradation"; dated Dec. 2007 (3 pages).
Chaji: "eUTDSP: a design study of a new VLIW-based DSP architecture"; dated May 2003 (4 pages).
Chaji: "Fast and Offset-Leakage Insensitive Current-Mode Line Driver for Active Matrix Displays and Sensors"; dated Feb. 2009 (8 pages).
Chaji : "High Speed Low Power Adder Design With a New Logic Style: Pseudo Dynamic Logic (SDL)"; dated Oct. 2001 (4 pages).
Chaji: "High-precision, fast current source for large-area current-programmed a-Si flat panels"; dated Sep. 2006 (4 pages).
Chaji : "Low-Cost AMOLED Television with IGNIS Compensating Technology"; dated May 2008 (4 pages).
Chaji : "Low-Cost Stable a-Si:H AMOLED Display for Portable Applications"; dated Jun. 2006 (4 pages).
Chaji : "Low-Power Low-Cost Voltage-Programmed a-Si:H AMOLED Display"; dated Jun. 2008 (5 pages).
Chaji : "Merged phototransistor pixel with enhanced near infrared response and flicker noise reduction for biomolecular imaging"; dated Nov. 2008 (3 pages).
Chaji : "Parallel Addressing Scheme for Voltage: Programmed Active-Matrix OLED Displays"; dated May 2007 (6 pages).
Chaji: "Pseudo dynamic logic (SDL): a high-speed and low-power dynamic logic family"; dated 2002 (4 pages).
Chaji : "Stable a-Si:H circuits based on short-term stress stability of amorphous silicon thin film transistors"; dated May 2006 (4 pages).
Chaji : "Stable Pixel Circuit for Small-Area High-Resolution a-Si:H AMOLED Displays"; dated Oct. 2008 (6 pages).
Chaji : "Stable RGBW AMOLED display with OLED degradation compensation using electrical feedback"; dated Feb. 2010 (2 pages).
Chaji : "Thin-Film Transistor Integration for Biomedical Imaging and AMOLED Displays"; dated 2008 (177 pages).
European Search Report for Application No. EP O11 12 2313 dated Sep. 14, 2005 ( 4 pages).
European Search Report for Application No. EP 04 78 6661 dated Mar. 9, 2009.
European Search Report for Application No. EP 05 82 1114 dated Mar. 27, 2009 (2 pages).
European Search Report for Application No. EP 05 75 9141 dated Oct. 30, 2009 (2 pages).
European Search Report for Application No. EP 05 81 9617 dated Jan. 30, 2009.
European Search Report for Application No. EP 06 70 5133 dated Jul. 18, 2008.
European Search Report for Application No. EP 06 72 1798 dated Nov. 12, 2009 (2 pages).
European Search Report for Application No. EP 07 71 0608.6 dated Mar. 19, 2010 (7 pages).
European Search Report for Application No. EP 07 71 9579 dated May 20, 2009.
European Search Report for Application No. EP 07 81 5784 dated Jul. 20, 2010 (2 pages).
European Search Report for Application No. EP 10 16 6143, dated Sep. 3, 2010 (2 pages).
European Search Report and Written Opinion for Application No. 08 86 5338, dated Nov. 2, 2011 (7 pages).
European Search Report in Application No. EP 10000421.7 (6 pages).
European Search Report for Application No. EP 10 83 4294.0-1903, dated Apr. 8, 2013, (9 pages).
European Supplementary Search Report for Application No. EP 04 78 6662 dated Jan. 19, 2007 (2 pages).
Extended European Search Report for Application No. 11 73 9485.8 dated Aug. 6, 2013 (14 pages).
Extended European Search Report for Application No. EP 09 73 3076,5, dated Apr. 27, 2011 (13 pages).
Extended European Search Report for Application No. EP 11 16 8677.0, dated Nov. 29, 2012, (13 page).
Extended European Search Report for Application No. EP 11 19 1641.7 dated Jul. 11, 2012 (14 pages).
Extended European Search Report for Application No. EP 10834297 dated Oct. 27, 2014 (6 pages).
Extended European Search Report for Application No. EP 16192749.6, dated Dec. 15, 2016 (17 pages).
Fossum, Eric R. "Active Pixel Sensors: Are CCD's Dinosaurs?" SPIE: Symposium on Electronic Imaging. Feb. 1, 1993 (13 pages).
Goh , "A New a-Si:H Thin-Film Transistor Pixel Circuit for Active-Matrix Organic Light-Emitting Diodes", IEEE Electron Device Letters, vol. 24, No. 9, Sep. 2003, pp. 583-585.
International Preliminary Report on Patentability for Application No. PCT/CA2005/001007 dated Oct. 16, 2006, 4 pages.
international Search Report for Application No. PCT/CA02/00180 dated Jul. 31, 2002 (3 pages).
International Search Report for Application No. PCT/CA2004/001741 dated Feb. 21, 2005.
international Search Report for Application No. PCT/CA2004/001742, Canadian Patent Office, dated Feb. 21, 2005 (2 pages).
International Search Report for Application No. PCT/CA2005/001007 dated Oct. 18, 2005.
International Search Report for Application No. PCT/CA2005/001897, dated Mar. 21, 2006 (2 pages).
International Search Report for Application No. PCT/CA2005/001844 dated Mar. 28, 2006 (2 pages).
International Search Report for Application No. PCT/CA2006/000177 dated Jun. 2, 2006.
International Search Report for Application No. PCT/CA2007/000652 dated Jul. 25, 2007.
International Search Report for Application No, PCT/CA2008/002307, dated Apr. 28, 2009 (3 pages).
International Search Report for Application No. PCT/CA2009/000501, dated Jul. 30, 2009 (4 pages).
International Search Report for Application No. PCT/CA2009/001769, dated Apr. 8, 2010 (3 pages).
International Search Report for Application No. PCT/IB2010/055481, dated Apr. 7, 2011, 3 pages.
International Search Report for Application No. PCT/IB2010/055486, dated Apr. 19, 2011, 5 pages.
International Search Report for Application No. PCT/IB2014/060959, dated Aug. 28, 2014, 5 pages.
International Search Report for Application No. PCT/IB2010/055541 filed Dec. 1, 2010, dated May 26, 2011; 5 pages.
International Search Report for Application No. PCT/IB2011/050502, dated Jun. 27, 2011 (6 pages).
international Search Report for Application No. PCT/IB2011/051103, dated Jul. 8, 2011, 3 pages.
International Search Report for Application No. PCT/IB2011/055135, Canadian Patent Office, dated Apr. 16, 2012 (5 pages).
International Search Report for Application No. PCT/IB2012/052372, dated Sep. 12, 2012 (3 pages).
International Search Report for Application No. PCT/IB2013/054251, Canadian Intellectual Property Office, dated Sep. 11, 2013; (4 pages).
International Search Report for Application No. PCT/JP02/09668, dated Dec. 3, 2002, (4 pages).

(56) References Cited

OTHER PUBLICATIONS

International Written Opinion for Application No. PCT/CA2004/001742, Canadian Patent Office. dated Feb. 21, 2005 (5 pages).
International Written Opinion for Application No. PCT/CA2005/001897, dated Mar. 21, 2006 (4 pages).
International Written Opinion for Application No. PCT/CA2009/000501 dated Jul. 30, 2009 (6 pages).
International Written Opinion for Application No. PCT/IB2010/055481, dated Apr. 7, 2011, 6 pages.
International Written Opinion for Application No. PCT/IB2010/055486, dated Apr. 19, 2011, 8 pages.
International Written Opinion for Application No. PCT/IB2010/055541, dated May 26, 2011; 6 pages.
International Written Opinion for Application No. PCT/IB2011/050502, dated Jun. 27, 2011 (7 pages).
International Written Opinion for Application No. PCT/IB2011/051103, dated Jul. 8, 2011, 6 pages.
International Written Opinion for Application No. PCT/IB2011/055135, Canadian Patent Office, dated Apr. 16, 2012 (5 pages).
International Written Opinion for Application No. PCT/IB2012/052372, dated Sep. 12, 2012 (6 pages).
International Written Opinion for Application No. PCT/IB2013/054251, Canadian Intellectual Property Office, dated Sep. 11, 2013; (5 pages).
Jafarabadiashtiani: "A New Driving Method for a-Si AMOLED Displays Based on Voltage Feedback"; dated 2005 (4 pages).
Kanicki. J., "Amorphous Silicon Thin-Film Transistors Based Active-Matrix Organic Light-Emitting Displays." Asia Display: International Display Workshops, Sep. 2001 (pp. 315-318).
Karim, K. S., "Amorphous Silicon Active Pixel Sensor Readout Circuit for Digital Imaging." IEEE: Transactions on Electron Devices. vol. 50, No. 1, Jan. 2003 (pp. 200-208).
Lee : "Ambipolar Thin-Film Transistors Fabricated by PECVD Nanocrystalline Silicon"; dated 2006.
Lee, Wonbok: "Thermal Management in Microprocessor Chips and Dynamic Backlight Control in Liquid Crystal Displays", PhD. Dissertation. University of Southern California. (124 pages).
Liu, P. et al., Innovative Voltage Driving Pixel Circuit Using Organic Thin-Film Transistor for AMOLEDs, Journal of Display Technology, vol. 5, Issue 6, Jun. 2009 (pp. 224-227).
Ma E Y: "organic light emitting diode/thin film transistor integration for foldable displays" dated Sep. 15, 1997(4 pages).
Matsueda y : "35.1: 2.5-in. AMOLED with Integrated 6-bit Gamma Compensated Digital Data Driver"; dated May 2004.
Mendes E., "A High Resolution Switch-Current Memory Base Cell." IEEE: Circuits and Systems. vol. 2, Aug. 1999 (pp. 718-721).
Nathan A , "Thin Film imaging technology on glass and plastic" ICM 2000, proceedings of the 12 international conference on microelectronics, dated Oct. 31, 2001 (4 pages).
Nathan, "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Nathan : "Backplane Requirements for active Matrix Organic Light Emitting Diode Displays,"; dated 2006 (16 pages).
Nathan : "Call for papers second international workshop on compact thin-film transistor (TFT) modeling for circuit simulation"; dated Sep. 2009 (1 page).
Nathan: "Driving schemes for a-Si and LTPS AMOLED displays"; dated Dec. 2005 (11 pages).
Nathan : "Invited Paper: a-Si for AMOLED—Meeting the Performance and Cost Demands of Display Applications (Cell Phone to HDTV)"; dated 2006 (4 pages).
Office Action in Japanese patent application No. JP2006-527247 dated Mar. 15, 2010 (8 pages).
Office Action in Japanese patent application No. JP2007-545796 dated Sep. 5, 2011 (8 pages).
Office Action in Chinese Patent Application 2009-10246264.4 dated Jul. 5, 2013 (8 pages).
Office Action in Japanese patent application No. JP2012-541612 dated Jul. 15, 2014 (3 pages).
Partial European Search Report for Application No. EP 11 168 677.0, dated Sep. 22, 2011 (5 pages).
Partial European Search Report for Application No. EP 11 19 1641.7, dated Mar. 20, 2012 (8 pages).
Philipp: "Charge transfer sensing" Sensor Review, vol. 19, No. 2, Dec. 31, 1999 (Dec. 31, 1999), 10 pages.
Rafati: "Comparison of a 17 b multiplier in Dual-rail domino and in Dual-rail D L (D L) logic styles"; dated 2002 (4 pages).
Safavian : "3-TFT active pixel sensor with correlated double sampling readout circuit for real-time medical x-ray imaging"; dated Jun. 2006 (4 pages).
Safavian: "A novel current scaling active pixel sensor with correlated double sampling readout circuit for real time medical x-ray imaging"; dated May 2007 (7 pages).
Safavian: "A novel hybrid active-passive pixel with correlated double sampling CMOS readout circuit for medical x-ray imaging"; dated May 2008 (4 pages).
Safavian: "Self-compensated a-Si:H detector with current-mode readout circuit for digital X-ray fluoroscopy"; dated Aug. 2005 (4 pages).
Safavian : "TFT active image sensor with current-mode readout circuit for digital x-ray fluoroscopy [5969D-82]"; dated Sep. 2005 (9 pages).
Safavian : "Three-TFT image sensor for real-time digital X-ray imaging"; dated Feb. 2, 2006 (2 pages).
Sanford, James L.. et al., "4.2 TFT AMOLED Pixel Circuits and Driving Methods," SID 03 Digest IS SN/0003. 2003, pp. 10-13.
Search Report for Taiwan Invention Patent Application No. 093128894 dated May 1, 2012 (1 page).
Search Report for Taiwan Invention Patent Application No. 94144535 dated Nov. 1, 2012 (1 page).
Singh,, "Current Conveyor: Novel Universal Active Block", Samriddhi, S-JPSET vol. I, Issue L 2010. pp. 41-48 (12EPPT).
Smith, Lindsay I., "A tutorial on Principal Components Analysis," dated Feb. 26, 2001 (27 pages).
Spindler, System Considerations for RGBW OLED Displays, Journal of the SID 14/1, 2006. pp. 37-48.
Stewart M., "polysilicon TFT technology for active matrix oled displays" IEEE transactions on electron devices, vol. 48, No. 5, dated May 2001 (7 pages).
Tatsuya Sasaoka et al.. "24.4L; Late-News Paper: A 13.0-inch AM-Oled Display with Top Emitting Structure and Adaptive Current Mode Programmed Pixel Circuit (TAC)," SID 01 Digest (2001), pp. 384-387.
Vygranenko : "Stability of indium-oxidethin-film transistors by reactive ion beam assisted deposition"; dated 2009.
Wang : "Indium oxides by reactive ion beam assisted evaporation: From material study to device application"; dated Mar. 2009 (6 pages).
Yi He, "Current-Source a-Si:H Thin Film Transistor Circuit for Active-Matrix Organic Light-Emitting Displays", IEEE Electron Device Letters, vol. 21, No. 12, Dec. 2000, pp. 590-592.
Yu, Jennifer: "Improve OLED Technology for Display", Ph.D. Dissertation, Massachusetts Institute of Technology, Sep. 2008 (151 pages).
Zhiguo Meng et al.; "24.3: Active-Matrix Organic Light-Emitting Diode Display implemented Using Metal-Induced Unilaterally Crystallized Polyciystalline Silicon Thin-Film Transistors," SID 01 Digest (2001), pp. 380-383.
International Search Report for Application No. PCT/IB2014/058244, Canadian Intellectual Property Office, dated Apr. 11, 2014; (6 pages).
International Search Report for Application No. PCT/IB2014/059753, Canadian Intellectual Property Office, dated Jun. 23, 2014; (6 pages).
Written Opinion for Application No. PCT/IB2014/059753, Canadian Intellectual Property Office, dated Jun. 12, 2014 (6 pages).
International Search Report for Application No. PCT/IB2014/060879, Canadian Intellectual Property Office, dated Jul. 17, 2014 (3 pages).
Extended European Search Report for Application No. EP 14158051.4, dated Jul. 29, 2014, (4 pages).

(56) References Cited

OTHER PUBLICATIONS

Office Action in Chinese PatentInvention No. 201180008188.9, dated Jun. 4, 2014 (17 pages) (w/English translation).
International Search Report for Application No. PCT/IB2014/066932 dated Mar. 24, 2015.
Written Opinion for Application No. PCT/IB2014/066932 dated Mar. 24, 2015.
Extended European Search Report for Application No. EP 11466291.5, dated Mar. 9, 2015, (9 pages).
Extended European Search Report for Application No. EP 14181848.4, dated Mar. 5, 2015, (8 pages).
Office Action in Chinese Patent Invention No. 201280022957.5, dated Jun. 26, 2015 (7 pages).
Extended European Search Report for Application No. EP 13794695.0, dated Dec. 18, 2015, (9 pages).

* cited by examiner

STABLE DRIVING SCHEME FOR ACTIVE MATRIX DISPLAYS

CROSS REFERENCE TO RELATED APPLICATIONS

This application is a continuation of U.S. patent application Ser. No. 15/807,339, filed Nov. 8, 2017, now allowed, which is a continuation of U.S. patent application Ser. No. 15/462,529, filed Mar. 17, 2017, now U.S. Pat. No. 9,842,544, which is a continuation of U.S. patent application Ser. No. 14/263,628, filed Apr. 28, 2014, now U.S. Pat. No. 9,633,597, which is a continuation of U.S. patent application Ser. No. 13/909,177, filed Jun. 4, 2013, now U.S. Pat. No. 8,743,096, which is a continuation of U.S. patent application Ser. No. 11/736,751, filed Apr. 18, 2007, now U.S. Pat. No. 8,477,121, issued Jul. 2, 2013, which claims priority to Canadian Patent Application No. 2,544,090, filed Apr. 19, 2006; the entire contents of each of the foregoing are incorporated herein by reference in their respective entireties.

FIELD OF INVENTION

The present invention relates to light emitting device displays, and more specifically to a method and system for driving a pixel circuit.

BACKGROUND OF THE INVENTION

Electro-luminance displays have been developed for a wide variety of devices, such as cell phones. In particular, active-matrix organic light emitting diode (AMOLED) displays with amorphous silicon (a-Si), poly-silicon, organic, or other driving backplane have become more attractive due to advantages, such as feasible flexible displays, its low cost fabrication, high resolution, and a wide viewing angle.

An AMOLED display includes an array of rows and columns of pixels, each having an organic light emitting diode (OLED) and backplane electronics arranged in the array of rows and columns. Since the OLED is a current driven device, the pixel circuit of the AMOLED should be capable of providing an accurate and constant drive current.

However, the AMOLED displays exhibit non-uniformities in luminance on a pixel-to-pixel basis, as a result of pixel degradation, i.e., aging caused by operational use over time (e.g., threshold shift, OLED aging). Depending on the usage of the display, different pixels may have different amounts of the degradation. There may be an ever-increasing error between the required brightness of some pixels as specified by luminance data and the actual brightness of the pixels. The result is that the desired image will not show properly on the display.

Therefore, there is a need to provide a method and system that is capable of suppressing the aging of the pixel circuit.

SUMMARY OF THE INVENTION

It is an object of the invention to provide a method and system that obviates or mitigates at least one of the disadvantages of existing systems.

In accordance with an aspect of the present invention there is provided a method of operating a pixel array having at least one pixel circuit. The method includes the steps of: repeating an operation cycle defining a frame period for a pixel circuit, including at each frame period, programming the pixel circuit, driving the pixel circuit; and relaxing a stress effect on the pixel circuit, prior to a next frame period.

In accordance with another aspect of the present invention there is provided a display system. The display system includes a pixel array including a plurality of pixel circuits and a plurality of lines for operation of the plurality of pixel circuits. Each of the pixel circuits includes a light emitting device, a storage capacitor, and a drive circuit connected to the light emitting device and the storage capacitor. The display system includes a drive for operating the plurality of lines to repeat an operation cycle having a frame period so that each of the operation cycle comprises a programming cycle, a driving cycle and a relaxing cycle for relaxing a stress on a pixel circuit, prior to a next frame period.

This summary of the invention does not necessarily describe all features of the invention.

BRIEF DESCRIPTION OF THE DRAWINGS

These and other features of the invention will become more apparent from the following description in which reference is made to the appended drawings wherein:

FIG. 10(*b*) is a diagram illustrating an example of array structure having bottom emission pixels applicable to the display system of FIG. 4.

DETAILED DESCRIPTION OF THE PREFERRED EMBODIMENTS

Embodiments of the present invention are described using a pixel circuit having an organic light emitting diode (OLED) and a plurality of thin film transistors (TFTs). The pixel circuit may contain a light emitting device other than the OLED. The transistors in the pixel circuit may be n-type transistors, p-type transistors or combinations thereof. The transistors in the pixel circuit may be fabricated using amorphous silicon, nano/micro crystalline silicon, poly silicon, organic semiconductors technologies (e.g., organic TFT), NMOS/PMOS technology, CMOS technology (e.g., MOSFET) or combinations thereof. A display having the pixel circuit may be a single color, multi-color or a fully color display, and may include one or more than one electroluminescence (EL) element (e.g., organic EL). The display may be an active matrix light emitting display (e.g., AMOLED). The display may be used in DVDs, personal digital assistants (PDAs), computer displays, or cellular phones. The display may be a flat panel.

In the description below, "pixel circuit" and "pixel" are used interchangeably. In the description below, "signal" and "line" may be used interchangeably. In the description below, the terms "line" and "node" may be used interchangeably. In the description below, the terms "select line" and "address line" may be used interchangeably. In the description below, "connect (or connected)" and "couple (or coupled)" may be used interchangeably, and may be used to indicate that two or more elements are directly or indirectly in physical or electrical contact with each other.

Figure 1:
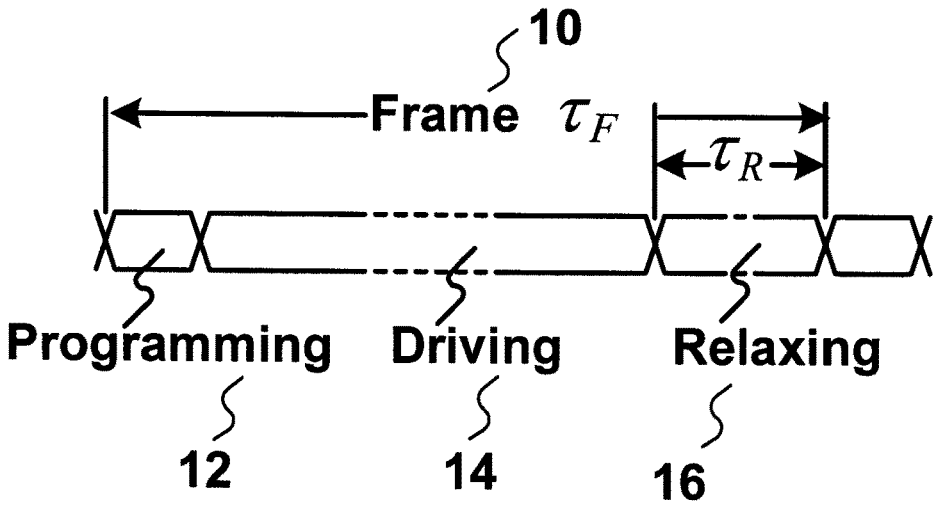
FIG. 1 is a timing chart for suppressing aging of a pixel circuit, in accordance with an embodiment of the present invention

FIG. 1 illustrates a timing schedule for suppressing aging for a pixel circuit, in accordance with an embodiment of the present invention. The pixel circuit, which is operated using the timing schedule of FIG. 1, includes a plurality of transistors and an OLED (e.g., 22, 24, 26 of FIG. 2). In FIG. 1, a frame 10 is divided into three phases: a programming cycle 12, a driving (i.e., emitting) cycle 14, and a relaxing cycle 16. The frame 10 is a time interval or period in which a display shows a frame of a video signal. During the programming cycle 12, a pixel circuit is programmed with required data to provide the wanted brightness. During the driving cycle 14, the OLED of the pixel circuit emits required brightness based on the programming data. Finally, during the relaxing cycle 16, the pixel circuit is OFF or biased with reverse polarity of the driving cycle 14. Consequently, the aging effect causes by the driving cycle 14 is annealed. This prevents aging accumulation effect from one frame to the other frame, and so the pixel life time increases significantly.

To obtain the wanted average brightness, the pixel circuit is programmed for a higher brightness since it is OFF for a fraction of frame time (i.e., relaxing cycle 16). The programming brightness based on wanted one is given by:

$$L_{CP} = \left(\frac{T_F}{T_F - T_R}\right) L_N \tag{1}$$

where "$L_{CP}$" is a compensating luminance, "$L_N$" is a normal luminance, "$T_R$" is a relaxation time (16 of FIG. 1), and "$T_F$" is a frame time (10 of FIG. 1).

As described below, letting the pixel circuit relax for a fraction of each frame can control the aging of the pixel, which includes the aging of driving devices (i.e., TFTs 24 and 26 of FIG. 2), the OLED (e.g., 22 of FIG. 1), or combinations thereof.

Figure 2:
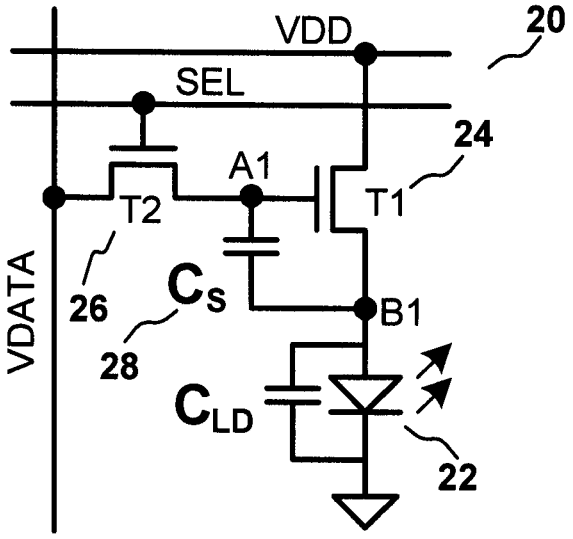
FIG. 2 is a diagram illustrating an example of a pixel circuit to which the timing schedule of FIG. 1 is suitably applied.

FIG. 2 illustrates an example of a pixel circuit to which the timing schedule of FIG. 1 is applicable. The pixel circuit 20 of FIG. 2 is a 2-TFT pixel circuit. The pixel circuit 20 includes an OLED 22, a drive TFT 24, a switch TFT 26, and a storage capacitor 28. Each of the TFTs 24 and 26 have a source terminal, a drain terminal and a gate terminal. In FIG. 2, $C_{LD}$ represents OLED capacitance. The TFTs 24 and 26 are n-type TFTs. However, it would be appreciated by one of ordinary skill in the art that the driving schemed of FIG. 1 is applicable to a complementary pixel circuit having p-type transistors or the combination of n-type and p-type transistors.

One terminal of the drive TFT 24 is connected to a power supply line VDD, and the other terminal of the drive TFT 24 is connected to one terminal of the OLED 22 (node B1). One terminal of the switch TFT 26 is connected to a data line VDATA, and the other terminal of the switch TFT 26 is connected to the gate terminal of the drive TFT 24 (node A1). The gate terminal of the switch TFT 26 is connected to a select line SEL. One terminal of the storage capacitor 28 is connected to node A1, and the other terminal of the storage capacitor 28 is connected to node B1.

Figure 3:
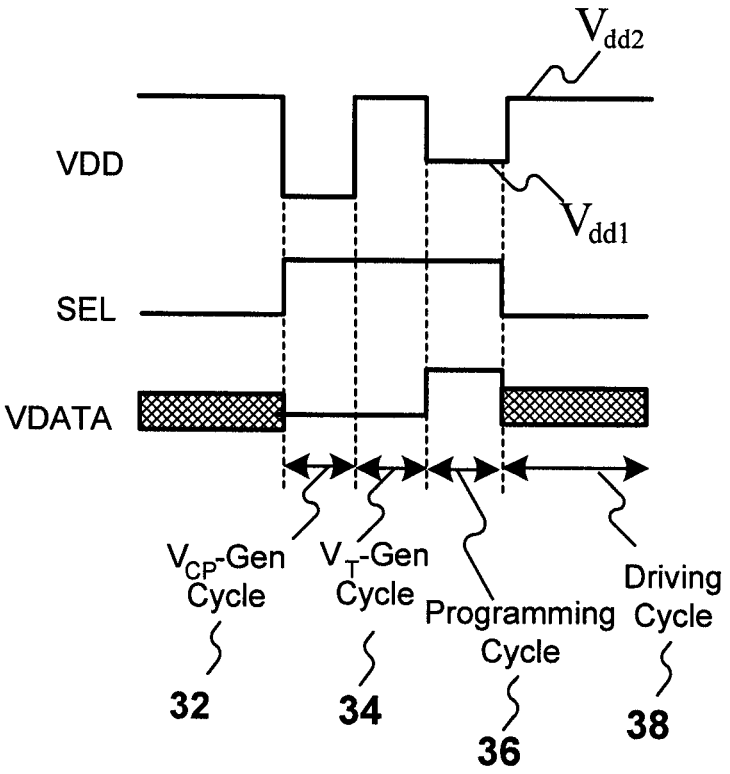
FIG. 3 is an exemplary timing chart for a compensating driving scheme in accordance with an embodiment of the present invention.

FIG. 3 illustrates an exemplary time schedule for a compensating driving scheme in accordance with an embodiment of the present invention, which is applicable to the pixel of FIG. 2. In FIG. 3, "32" represents "$V_{CP}$-Gen cycle", "34" represents "$V_T$-Gen cycle", "36" represents "programming cycle" and associated with the programming cycle 12 of FIG. 1, and "38" represents "driving cycle" and associated with the driving cycle 14 of FIG. 1.

The waveforms of FIG. 3 are used, for example, in the cycles 12 and 14 of FIG. 1. During the $V_{CP}$-Gen cycle 32, a voltage is developed across the gate-source voltage of a drive TFT (e.g., 24 of FIG. 2). During the $V_T$-Gen cycle 34, voltage at node B1 becomes $-V_T$ of the drive TFT (e.g., 24 of FIG. 2) where $V_T$ is the threshold voltage of the drive TFT (e.g., 24 of FIG. 2). During the programming cycle 36, node A1 is charged to $V_P$ which is related to Lcp of (1).

Referring to FIGS. 2 and 3, during the first operating cycle 32 ("$V_{CP}$-Gen"), VDD changes to a negative voltage ($-V_{CPB}$) while VDATA has a positive voltage ($V_{CPA}$). Thus, node A1 is charged to $V_{CPA}$, and node B1 is discharged to $-V_{CPB}$. $V_{CPA}$ is smaller than $V_{TO}+V_{OLEDO}$, where the $V_{TO}$ is the threshold voltage of the unstressed drive TFT 24 and the $V_{OLEDO}$ is the ON voltage of the unstressed OLED 22.

During the second operating cycle 34 ("$V_T$-Gen"), VDD changes to $V_{dd2}$ that is a voltage during the driving cycle 38. As a result, node B1 is charged to the point at which the drive TFT 24 turns off. At this point, the voltage at node B1 is ($V_{CPA}-V_T$) where $V_T$ is the threshold of the drive TFT 24, and the voltage stored in the storage capacitor 28 is the $V_T$ of the drive TFT 24.

During the third operating cycle 36 ("programming cycle"), VDATA changes to a programming voltage, $V_{CPA}+V_P$. VDD goes to Vdd1 which is a positive voltage. Assuming that the OLED capacitance ($C_{LD}$) is large, the voltage at node B1 remains at $V_{CPA}-V_T$. Therefore, the gate-source voltage of the drive TFT 24 ideally becomes $V_P+V_T$. Consequently, the pixel current becomes independent of ($\Delta V_T+\Delta V_{OLED}$) where $\Delta V_T$ is a shift of the threshold voltage of the drive TFT 24 and $\Delta V_{OLED}$ is a shift of the ON voltage of the OLED 22.

Figure 4:
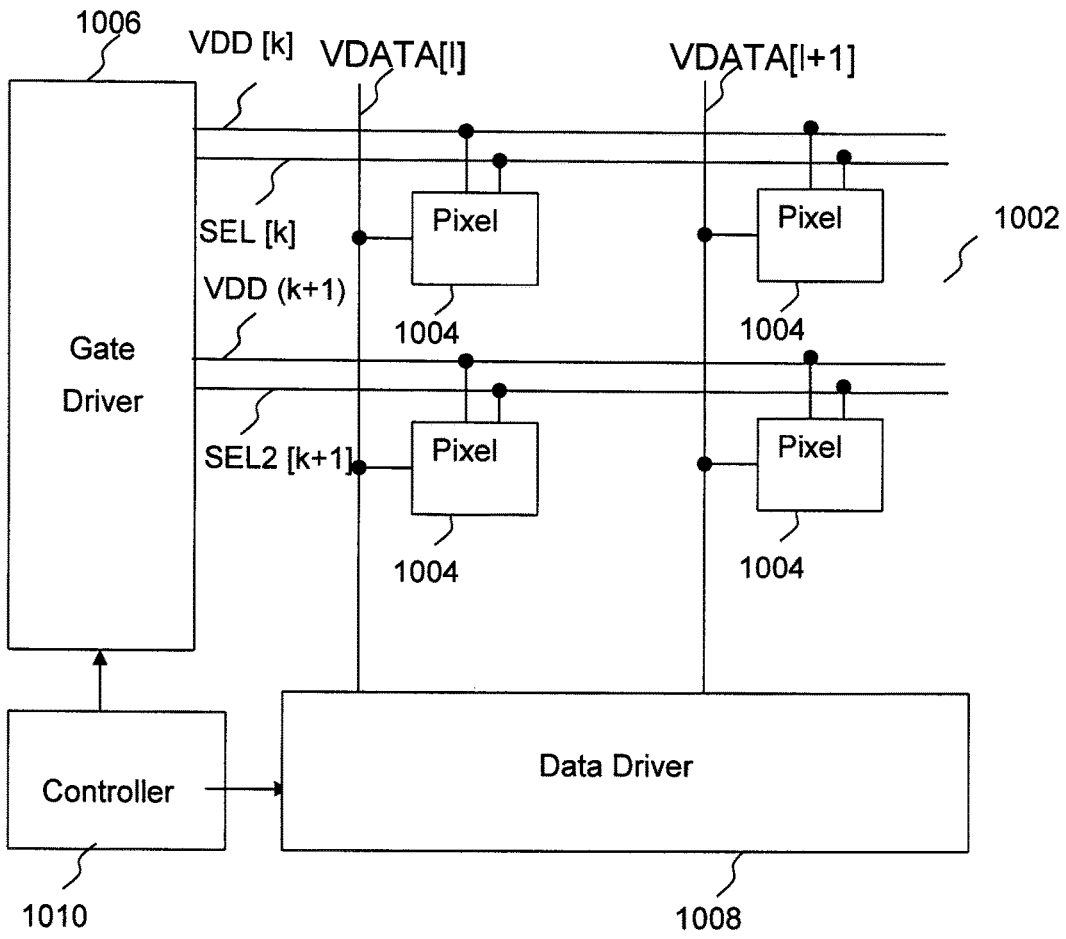
FIG. 4 is a diagram illustrating an example of a display system for implementing the timing schedule of FIG. 1 and the compensating driving scheme of FIG. 3.

FIG. 4 illustrates an example of a display system for implementing the timing schedule of FIG. 1 and the compensating driving scheme of FIG. 3. The display system 1000 includes a pixel array 1002 having a plurality of pixels 1004. The pixel 1004 corresponds to the pixel 20 of FIG. 2. However, the pixel 1004 may have structure different from that of the pixel 20. The pixels 1004 are arranged in row and column. In FIG. 4, the pixels 1004 are arranged in two rows and two columns. The number of the pixels 1004 may vary in dependence upon the system design, and does not limited to four. The pixel array 1002 is an active matrix light emitting display, and may form an AMOLED display.

"SEL[i]" is an address line for the ith row (i= . . . k, k+1 . . . ) and corresponds to SEL of FIG. 2. "VDD[i]" is a power supply line for the ith row (i= . . . k, k+1 . . . ) and corresponds to VDD of FIG. 2. "VDATA[j]" is a data line for the jth row (i= . . . l, l+1 . . . ) and corresponds to VDATA of FIG. 2.

A gate driver 1006 drives SEL[i] and VDD[i]. The gate driver 1006 includes an address driver for providing address signals to SEL[i]. A data driver 1008 generates a programming data and drives VDATA[j]. The controller 1010 controls the drivers 1006 and 1008 to drive the pixels 1004 based on the timing schedule of FIG. 1 and the compensating driving scheme of FIG. 3.

Figure 5:
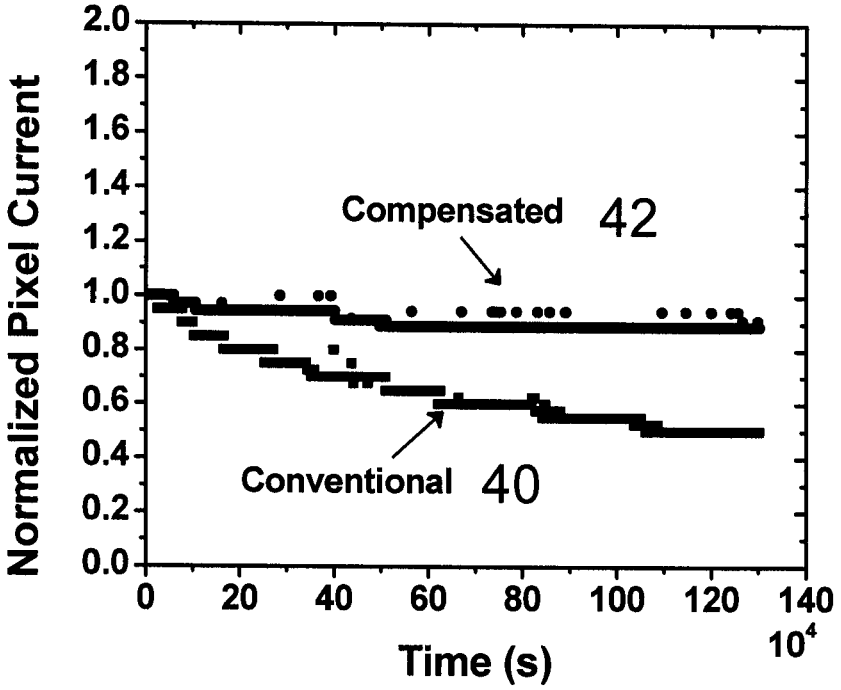
FIG. 5 is a graph illustrating measurement results for a conventional driving scheme and the compensating driving scheme of FIG. 3.

FIG. 5 illustrates lifetime results for a conventional driving scheme and the compensating driving scheme. Pixel circuits of FIG. 2 are programmed for 2 μA at a frame rate of ~60 Hz by using the conventional driving scheme (40) and the compensating driving scheme (42). The compensating driving scheme (42) is highly stable, reducing the total aging error to less than 10%. By contrast, in the conventional driving scheme (40), while the pixel current becomes half of its initial value after 36 hours, the aging effects result in a 50% error in the pixel current over the measurement period. The total shift in the OLED voltage and threshold voltage of the drive TFT (i.e., 24 of FIG. 2), $\Delta(V_{OLED}+V_T)$, is ~4 V.

Figure 6:
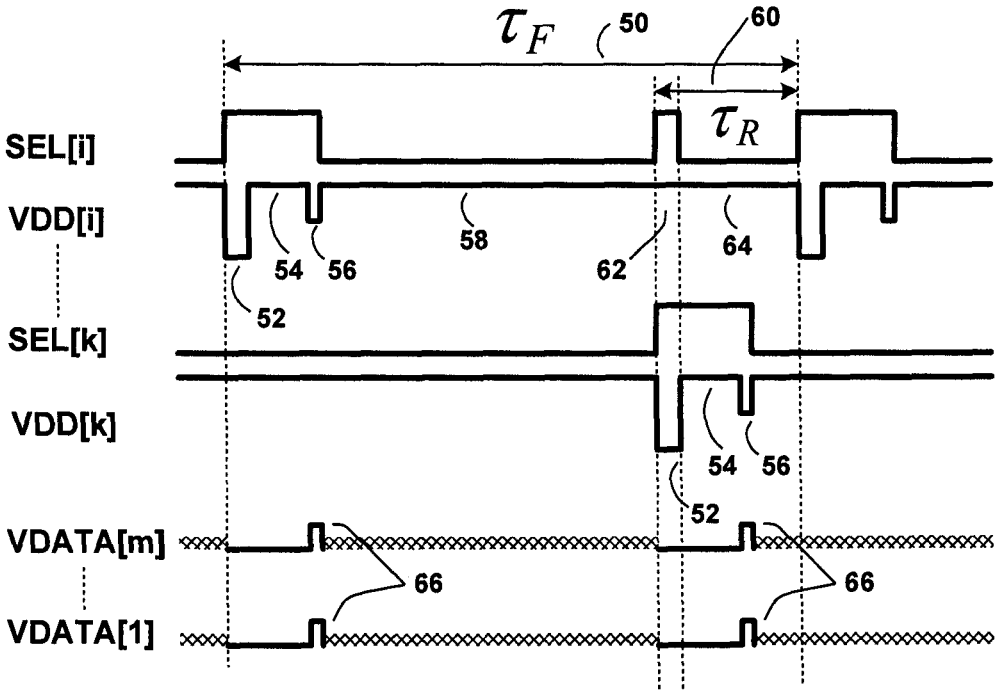
FIG. 6 is a timing chart illustrating an example of frames based on the timing schedule of FIG. 1 and the compensating driving scheme of FIG. 3.

FIG. 6 illustrates an example of frames using the timing schedule of FIG. 1 and the compensating driving scheme of FIG. 3.

In FIG. 6, "i" represents the ith row in a pixel array, "k" represents the kth row in the pixel array, "m" represents the mth column in the pixel array, and "l" represents the lth column in the pixel array. The waveforms of FIG. 6 are applicable to the display system 1000 of FIG. 4 to operate the pixel array 1002 of FIG. 4. It is assumed that the pixel array includes more than one pixel circuit 20 of FIG. 2.

In FIG. 6, "50" represents a frame for the ith row and corresponds to "10" of FIG. 1, "52" represents "$V_{CP}$-Gen cycle" and corresponds to "32" of FIG. 3, "54" represents "$V_T$-Gen cycle" and corresponds to "34" of FIG. 3, and "56" represents "programming cycle" and corresponds to "36" of FIG. 3. In FIG. 6, "58" represents "driving cycle" and corresponds to "38" of FIG. 3. In FIG. 6, "66" represents the values of the corresponding VDATA lines during the operating cycle 56.

In FIG. 6, "60" represents a relaxing cycle for the ith row and corresponds to "16" of FIG. 1. The relaxing cycle 60 includes a first operating cycle "62" and a second operating cycle "64". During the relaxing cycle 60 for the ith row, SEL[i] is high at the first operating cycle 62 and then is low at the second operating cycle 64. During the frame cycle 62, node A1 of each pixel at the ith row is charged to a certain voltage, such as, zero. Thus, the pixels are OFF during the frame cycle 64. "$V_{CP}$-Gen cycle" 52 for the kth row occurs at the same timing of the first operating cycle 62 for the ith row.

During the first operating cycle 52 for the kth row, which is the same as the first operating cycle 62 for the ith row, SEL[i] is high, and so the storage capacitors of the pixel circuits at the ith row are charged to $V_{CP4}$. VDATA lines have $V_{CP4}$. Considering that $V_{CP4}$ is smaller than $V_{OLEDO}+V_{T0}$, the pixel circuits at the ith row are OFF at the second operating cycle 64 and also the corresponding drive TFTs (24 of FIG. 2) are negatively biased resulting in partial annealing of the $V_T$-shift at the cycle 64.

Figure 7:
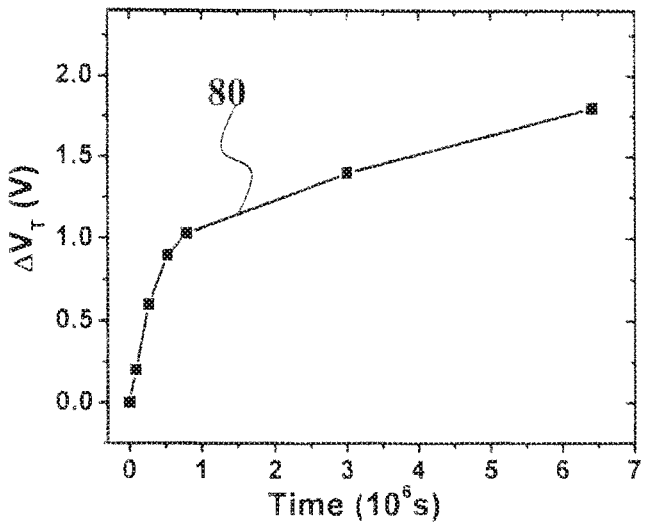
FIG. 7 is a graph illustrating the measurement result of threshold voltage shift based on the compensating driving scheme of FIG. 6.
Figure 8:
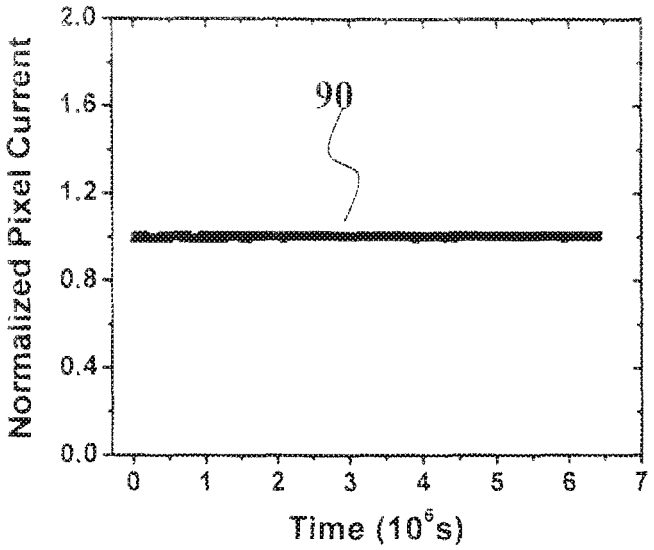
FIG. 8 is a graph illustrating the measurement result of OLED current based on the compensating driving scheme of FIG. 6.

FIGS. 7 and 8 illustrate results of a longer lifetime test for a pixel circuit employing the timing cycles of FIG. 6. To obtain data of FIGS. 7 and 8, a pixel array having more than one pixel 20 of FIG. 2 was used.

In FIG. 7, "80" represents the measurement result of the shift in the threshold voltage of the drive transistor (i.e., 24 of FIG. 2). The result signifies that the above method and results in a highly stable pixel current even after 90 days of operation. Here, the pixel of FIG. 2 is programmed for 2.5 μA to compensate for the luminance lost during the relaxing cycle. The $\Delta(V_{OLED}+V_T)$ is extracted once after a long timing interval (few days) to not disturb pixel operation. It is clear that the OLED current is significantly stable after 1500 hours of operation which is the results of suppression in the aging of the drive TFT (i.e., 24 of FIG. 2) as shown in FIG. 7.

In FIG. 8, "90" represents the measurement result of OLED current of the pixel (i.e., 20 of FIG. 2) over time. The result depicted in FIG. 8 confirms that the enhanced timing diagram suppresses aging significantly, resulting in longer lifetime. Here, $\Delta(V_{OLED}+V_T)$ is 1.8 V after a 90 days of operation, whereas it is 3.6 V for the compensating driving scheme without the relaxing cycle after a shorter time.

Figure 9:
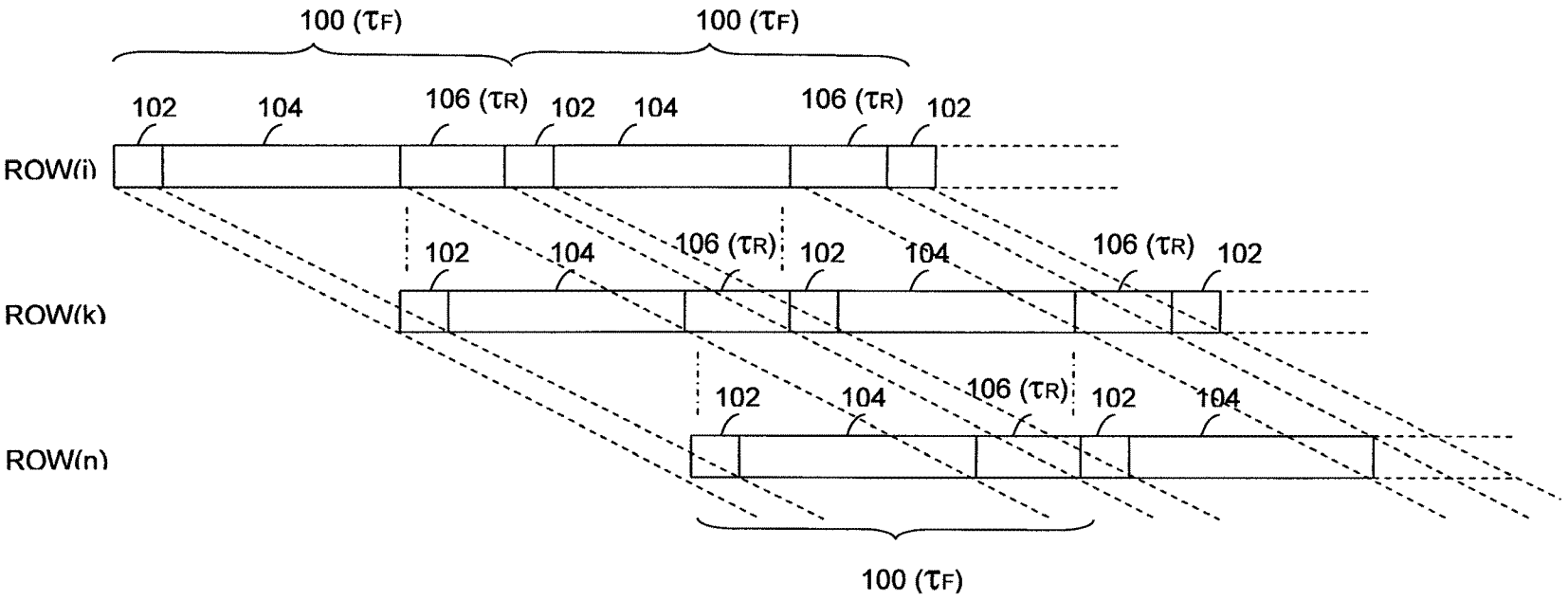
FIG. 9 is a diagram illustrating an example of a driving scheme applied to a pixel array, in accordance with an embodiment of the present invention.

FIG. 9 is a diagram illustrating an example of the driving scheme applied to a pixel array, in accordance with an embodiment of the present invention. In FIG. 9, each of ROW(i), ROW(k) and ROW(n) represents a row of the pixel array. The pixel array may be the pixel array 1002 of FIG. 4. The frame 100 of FIG. 9 includes a programming cycle 102, a driving cycle 104, and a relaxing cycle 106, and has a frame time "$t_F$". The programming cycle 102, the driving cycle 104, and the relaxing cycle 106 may correspond to the operation cycles 12, 14, and 16 of FIG. 1, respectively. The programming cycle 102 may include the operating cycles 32, 34 and 36 of FIG. 3. The relaxing cycle 106 may be similar to the relaxing cycle 60 of FIG. 6.

The programming cycle 102 for the kth row occurs at the same timing of the relaxing cycle 106 for the ith row. The programming cycle 102 for the nth row occurs at the same timing of the relaxing cycle 106 for the kth row.

Figure 10A:
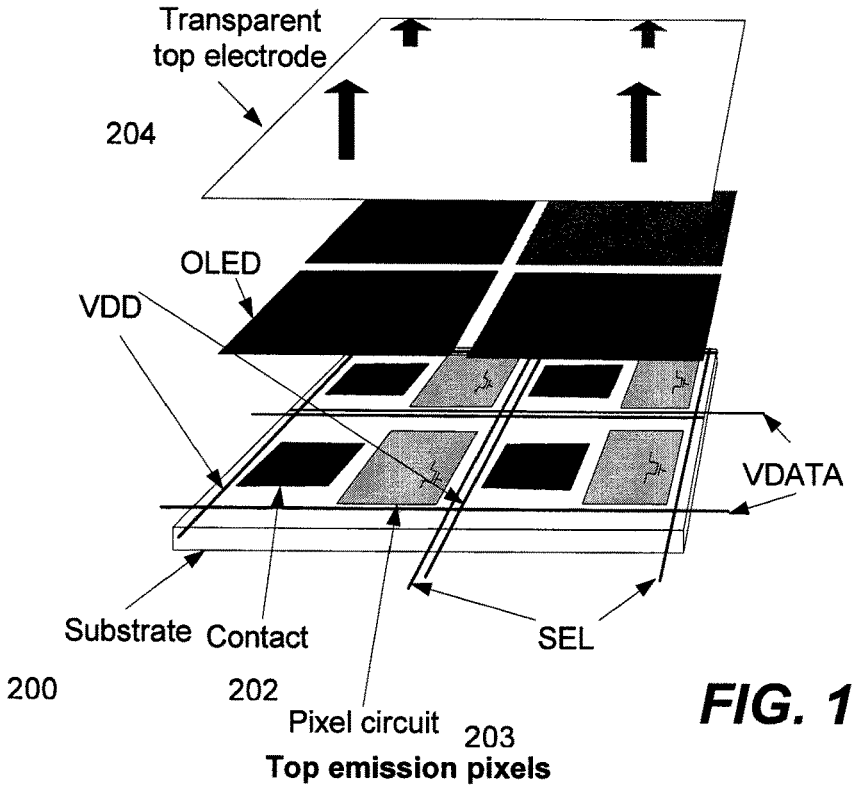
FIG. 10(*a*) is a diagram illustrating an example of array structure having top emission pixels applicable to the display system of FIG. 4.
Figure 10B:
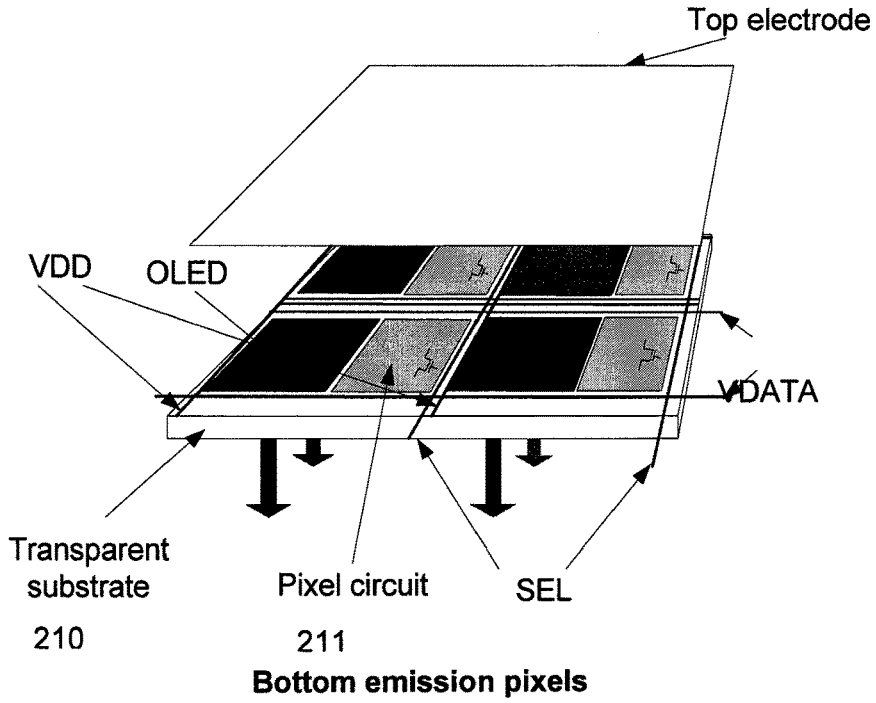

FIG. 10(*a*) illustrates an example of array structure having top emission pixels. FIG. 10(*b*) illustrates an example of array structure having bottom emission pixels. The pixel array of FIG. 4 may have the array structure of FIG. 10(*a*) or 10(*b*). In FIG. 10(*a*), 200 represents a substrate, 202 represents a pixel contact, 203 represents a (top emission) pixel circuit, and 204 represents a transparent top electrode on the OLEDs. In FIG. 10(*b*), 210 represents a transparent substrate, 211 represents a (bottom emission) pixel circuit, and 212 represents a top electrode. All of the pixel circuits including the TFTs, the storage capacitor, the SEL, VDATA, and VDD lines are fabricated together. After that, the OLEDs are fabricated for all pixel circuits. The OLED is connected to the corresponding driving transistor using a via (e.g., B1 of FIG. 2) as shown in FIGS. 10(*a*) and 10(*b*). The panel is finished by deposition of the top electrode on the OLEDs which can be a continuous layer, reducing the complexity of the design and can be used to turn the entire display ON/OFF or control the brightness.

In the above description, the pixel circuit 20 of FIG. 2 is used as an example of a pixel circuit for implementing the timing schedule of FIG. 1, the compensating driving schedule of FIG. 3, and the timing schedule of FIG. 6. However, it is appreciated that the above timing schedules of FIGS. 1, 3 and 6 are applicable to pixel circuits other than that of FIG. 2, despite its configuration and type.

Examples of the driving scheme, compensating and driving scheme, and pixel/pixel arrays are described in G. R. Chaji and A. Nathan, "Stable voltage-programmed pixel circuit for AMOLED displays," IEEE J. of Display Technology, vol. 2, no. 4, pp. 347-358, December 2006, which is hereby incorporated by reference.

One or more currently preferred embodiments have been described by way of example. It will be apparent to persons skilled in the art that a number of variations and modifications can be made without departing from the scope of the invention as defined in the claims.

What is claimed is:

1. A method of operating a pixel array having pixel circuits, each pixel circuit including a drive transistor and a light emitting device, and driven by repeating an operation cycle defining a frame period for each pixel circuit, the method comprising:

selecting a first pixel circuit during a first operation cycle of a frame period of the first pixel circuit; and selecting a second pixel circuit during said selecting the first pixel circuit during a second operation cycle of a frame period of the second pixel circuit, the first operation cycle different from the second operation cycle.

2. The method of claim 1, wherein the first operation cycle comprises a first programming operation cycle and wherein the second operation cycle comprises a first relaxing operation cycle.

3. The method of claim 1, further comprising:

during said selecting the first pixel circuit and said selecting the second pixel circuit, providing first voltages to the first pixel circuit and second voltages to the second pixel circuit.

4. The method of claim 3, wherein the first voltages are sufficient to cause, during the first operation cycle of the frame period of the first pixel circuit, the drive transistor of the first pixel circuit to turn on and the light emitting device of the first pixel circuit to remain off.

5. The method of claim 3, wherein the second voltages are sufficient to cause, during the second operation cycle of the frame period of the second pixel circuit, the drive transistor of the second pixel circuit to turn off and the light emitting device of the second pixel circuit to turn off.

6. The method of claim 3, wherein the second voltages are sufficient to cause, during the second operation cycle of the frame period of the second pixel circuit, negative biasing of the transistor of the second pixel circuit.

7. The method of claim 3, wherein the first voltages and the second voltages each comprise a first voltage provided via a data line coupled to the first pixel circuit and the second pixel circuit, wherein the first voltages comprise a first supply voltage used to drive the light emitting device of the first pixel circuit, wherein the second voltages comprise a second supply voltage used to drive the light emitting device of the second pixel circuit, the first supply voltage different from the second supply voltage, and wherein a polarity of the first supply voltage is opposite in polarity to that of the first voltage.

8. The method of claim 3, wherein the first voltages and the second voltages each comprise a first voltage provided via a data line coupled to the first pixel circuit and the second pixel circuit, the method further comprising:

providing a second voltage to the first pixel circuit over the data line during a second operation cycle of the frame period of the first pixel circuit, the second voltage comprising at least a programming voltage for the first pixel circuit; and deselecting the second pixel circuit during the second operation cycle of the frame period of the first pixel circuit isolating the second pixel circuit from the second voltage.

9. The method of claim 1, wherein the first voltages comprise a first voltage provided over a data line coupled to the first pixel circuit and the second pixel circuit, the first voltage smaller than $V_{T0}+V_{OLED0}$ where $V_{T0}$ is a threshold voltage of the drive transistor of the first pixel circuit in an unstressed state and $V_{OLED0}$ is an on voltage of the light-emitting device of the first pixel circuit in an unstressed state.

10. The method of claim 1, further comprising:

deselecting the second pixel circuit at the end of the second operation cycle of the frame period of the second pixel circuit.

11. A display system comprising:

a pixel array having pixel circuits, each pixel circuit including a drive transistor and a light emitting device;

a driver coupled to the pixel circuits and for driving the pixel circuits by repeating an operation cycle defining a frame period for each pixel circuit;

and a controller coupled to the driver, the controller operable to:

select a first pixel circuit during a first operation cycle of a frame period of the first pixel circuit; and select a second pixel circuit during said selecting the first pixel circuit and during a second operation cycle of a frame period of the second pixel circuit, the first operation cycle different from the second operation cycle.

12. The display system of claim 11, wherein the first operation cycle comprises a first programming operation cycle and wherein the second operation cycle comprises a first relaxing operation cycle.

13. The display system of claim 11, wherein the controller is further operable to:

during selection of the first pixel circuit and selection of the second pixel circuit, provide first voltages to the first pixel circuit and second voltages to the second pixel circuit.

14. The display system of claim 13, wherein the first voltages are sufficient to cause, during the first operation cycle of the frame period of the first pixel circuit, the drive transistor of the first pixel circuit to turn on and the light emitting device of the first pixel circuit to remain off.

15. The display system of claim 13, wherein the second voltages are sufficient to cause, during the second operation cycle of the frame period of the second pixel circuit, the drive transistor of the second pixel circuit to turn off and the light emitting device of the second pixel circuit to turn off.

16. The display system of claim 13, wherein the second voltages are sufficient to cause, during the second operation cycle of the frame period of the second pixel circuit, negative biasing of the transistor of the second pixel circuit.

17. The display system of claim 13, wherein the first voltages and the second voltages each comprise a first voltage provided via a data line coupled to the first pixel circuit and the second pixel circuit, wherein the first voltages comprise a first supply voltage used to drive the light emitting device of the first pixel circuit, wherein the second voltages comprise a second supply voltage used to drive the light emitting device of the second pixel circuit, the first supply voltage different from the second supply voltage, and wherein a polarity of the first supply voltage is opposite in polarity to that of the first voltage.

18. The display system of claim 13, wherein the first voltages and the second voltages each comprise a first voltage provided via a data line coupled to the first pixel circuit and the second pixel circuit, wherein the controller is further operable to:

provide a second voltage to the first pixel circuit over the data line during a second operation cycle of the frame period of the first pixel circuit, the second voltage comprising at least a programming voltage for the first pixel circuit; and deselect the second pixel circuit during the second operation cycle of the frame period of the first pixel circuit isolating the second pixel circuit from the second voltage.

19. The display system of claim 13, wherein the first voltages comprise a first voltage provided over a data line coupled to the first pixel circuit and the second pixel circuit, the first voltage smaller than $V_{T0}+V_{OLED0}$ where $V_{T0}$ is a threshold voltage of the drive transistor of the first pixel circuit in an unstressed state and $V_{OLED0}$ is an on voltage of the light-emitting device of the first pixel circuit in an unstressed state.

20. The display system of claim 11, wherein the controller is further operable to:

deselect the second pixel circuit at the end of the second operation cycle of the frame period of the second pixel circuit.

* * * * *